US009114606B1

(12) United States Patent
Ready et al.

(10) Patent No.: US 9,114,606 B1
(45) Date of Patent: Aug. 25, 2015

(54) SPATIAL LIGHT MODULATION METHOD FOR DETERMINING DROPLET MOTION CHARACTERISTICS

(71) Applicant: Palo Alto Research Center Incorporated, Palo Alto, CA (US)

(72) Inventors: Steven E. Ready, Los Altos, CA (US); Peter Kiesel, Palo Alto, CA (US); Joerg Martini, San Francisco, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 14/246,893

(22) Filed: Apr. 7, 2014

(51) Int. Cl.
*B41J 29/38* (2006.01)
*B41J 2/045* (2006.01)

(52) U.S. Cl.
CPC ..... *B41J 2/0456* (2013.01)

(58) Field of Classification Search
USPC ..... 347/9, 10, 14, 16, 17, 19, 40
See application file for complete search history.

(56) References Cited

U.S. PATENT DOCUMENTS

| | | | | |
|---|---|---|---|---|
| 6,213,579 | B1 * | 4/2001 | Cornell et al. | 347/14 |
| 7,104,634 | B2 * | 9/2006 | Weksler et al. | 347/19 |
| 7,358,476 | B2 | 4/2008 | Kiesel et al. | |
| 7,386,199 | B2 | 6/2008 | Schmidt et al. | |
| 7,420,677 | B2 | 9/2008 | Schmidt et al. | |
| 7,547,904 | B2 | 6/2009 | Schmidt et al. | |
| 7,688,427 | B2 | 3/2010 | Cox et al. | |
| 7,701,580 | B2 | 4/2010 | Bassler et al. | |
| 7,894,068 | B2 | 2/2011 | Bassler et al. | |
| 8,203,711 | B2 | 6/2012 | Shinoda | |
| 8,373,860 | B2 | 2/2013 | Kiesel et al. | |
| 8,388,569 | B2 | 3/2013 | Uhland et al. | |
| 8,629,981 | B2 | 1/2014 | Martini et al. | |
| 2008/0181827 | A1 | 7/2008 | Bassler et al. | |
| 2008/0183418 | A1 | 7/2008 | Bassler et al. | |
| 2012/0194590 | A1 * | 8/2012 | Suzuki | 347/14 |
| 2012/0236291 | A1 | 9/2012 | Pittaro et al. | |
| 2012/0271221 | A1 | 10/2012 | Uhland et al. | |
| 2013/0016335 | A1 | 1/2013 | Lo et al. | |
| 2013/0037726 | A1 | 2/2013 | Kiesel et al. | |

FOREIGN PATENT DOCUMENTS

| | | |
|---|---|---|
| WO | WO0194938 | 12/2001 |
| WO | WO2005017969 | 2/2005 |

OTHER PUBLICATIONS

U.S. Appl. No. 14/155,094, Martini et al., filed Jan. 14, 2014.
(Continued)

*Primary Examiner* — Kristal Feggins
(74) *Attorney, Agent, or Firm* — Hollingsworth Davis, LLC

(57) ABSTRACT

Approaches for determining the delivery success of a droplet from an ink jet print head are disclosed. On approach utilizes an apparatus for the ink jet printer that includes an ejector, a spatial filter, a detector, and an analyzer. The ejector is configured to release an ink droplet along a path and the spatial filter has a plurality of features. The detector is positioned to sense light emanating from the droplet along the path with the sensed light being modulated according to the features as the droplet moves along the path relative to the spatial filter. The detector is configured to generate a time-varying electrical signal in response to the sensed light. The analyzer determines one or more physical, spatial, or dynamic characteristics of the droplet based upon the time-varying signal.

25 Claims, 14 Drawing Sheets

(56) References Cited

OTHER PUBLICATIONS

U.S. Appl. No. 14/181,524, Martini et al., filed Feb. 14, 2014.
U.S. Appl. No. 14/181,530, Martini et al., filed Feb. 14, 2014.
U.S. Appl. No. 14/181,560, Kletter et al., filed Feb. 14, 2014.
U.S. Appl. No. 14/181,571, Martini et al., filed Feb. 14, 2014.
Kiesel et al., "Spatially Modulated Fluorescence Emission from Moving Particles", Appl. Phys. Lett. 94, 2009, pp. 041107-1-041107-3.
Kiesel et al., "Spatially Modulated Emission Advances Point-of-Care Diagnostics", Laser Focus World, Nov. 2010, pp. 47-50.
Petersson et al., "Free Flow Acoustophoresis: Micorfluidic-Based Mode of Particle and Cell Separation", Anal. Chem, 79 (14), 2007, pp. 5117-5123.
Yamada et al., "Pinched flow fractionation: continuous size separation of particles utilizing a laminar flow profile in a pinched microchannel", Anal. Chem. 76 (18), Sep. 2004, pp. 5465-5471. (abstract only).
Yamada et al., "Microfluidic Particle Sorter Employing Flow Splitting and Recombining", Anal. Chem. 78, 2006, pp. 1357-1362.
Ji et al., "Silicon-based microfilters for whole blood cell separation", Biomed Microdevices 10(2), 2008, pp. 251-257. (abstract only).
Schrum et al., "Microchip Flow Cytometry Using Electrokinetic Focusing", Anal. Chem. 71 (19), Oct. 1999, pp. 4173-4177. (abstract only).
Huh et al., "Microfluidics for flow cytometric analysis of cells and particles" Physiol. Meas. 26 (3), Jun 2005, pp. R73-98. (abstract only).
Fu et al., "Electrokinetically driven cytometers with integrated fiber optics for on-line cell/participle detection", Analytica Chimica ACTA, Vo. 507 (1), Apr. 2004, pp. 163-169. (abstract only).
Lee, Gwo-Bin et al., "Micromachine-based multi-channel flow cytometers for cell/particle counting and sorting", J. Micromech, Microeng. 15 (2005) 447-454. (abstract only).
Lin et al., "Vertical focusing device utilizing dietectrophoretic force and its application on mlcroflow cytometer", Journal of Microelectrormechanical Systems, vol. 13, No. 6, Dec. 2004, 10 pages.
Zhu et al., "Dielectrophoretic focusing of particles in a microchannel constriction using DC-biased AC flectric fields", Electrophoresis, vol. 30 (15), Jul. 2009. (abstract only).
Chu et al., "A three-dimensional (3D) particle focusing channel using the positive dielectrophoresis (pDEP) guided by a dielectric structure between two planar electrodes", Lab on a Chip, Issue 5m 2009, pp. 688-691. (abstract only).
Chang et al., Three-dimensional hydrodynamic focusing in two-layer polydimethylsiloxane (PDMS) microchannels, J. Michromech. Microeng 17, 2007, pp. 1479-1486.
Sheng et al., "Digital holographic microscope for measuring three-dimensional particle distributions and motions", Applied Optics, Vo. 45 (16), Jun. 2006, pp. 3893-3901.
Lindken et al., "Stereoscopic micro particle image velocimetry" Experiments in Fluids, 41, 2006, pp. 161-171.
Pereira et al., "Microscale 3D flow mapping with μDDPIV", Experiments in Fluids, vol. 42 (4), Apr. 2007, pp. 589-599. (abstract only).
Cheong et al., "Flow Visualization and Flow Cytometry with Holographic Video Microscopy", Optics Express 17, 2009, pp. 13071-13079.
Lima et al., "Confocal micro-PIV measurements of three dimensional profiles of cell suspension flow in a square microchannel", Measurement Science and Technology, vol. 17, 2006, pp. 797-808.
Pugia et al., "Microfluidic Tool Box as Technology Platform for Hand-Held Diagnostics", Clinical Chemistry, vol. 51 (10), 2005, pp. 1923-1932.
File History for U.S. Appl. No. 13/206,436 as retrieved from the U.S. Patent and Trademark Office Pair System on Feb. 14, 2014, 119 pages.
File History for U.S. Appl. No. 12/024,490 as retrieved from the U.S. Patent and Trademark Office Pair System on Feb. 14, 2014, 376 pages.
File History for U.S. Appl. No. 12/762,702 as retrieved from the U.S. Patent and Trademark Office Pair System on Feb. 14, 2014, 377 pages.
File History for U.S. Appl. No. 13/113,021 as retrieved from the U.S. Patent and Trademark Office Pair System on Feb. 14, 2014, 704 pages.

* cited by examiner

SPATIAL LIGHT MODULATION METHOD FOR DETERMINING DROPLET MOTION CHARACTERISTICS

TECHNICAL FIELD

This disclosure relates generally to techniques for performing system or sample analysis by evaluating light interacting with ink droplets. More particularly, the application relates to techniques for monitoring delivery of ink droplets in an inkjet printer, and to components, devices, systems, and methods pertaining to such techniques.

BACKGROUND

Ink jet printers operate by ejecting small droplets of liquid ink through a nozzle onto print media according to a predetermined pattern. In some implementations, the ink is ejected directly on a final print media, such as paper. In other implementations, the ink is ejected on an intermediate print media, e.g. a print drum, and is then transferred from the intermediate print media to the final print media.

On occasion, the nozzles of ink jet printers can become obstructed, blocked, or otherwise develop non-uniformities such that the droplets are ejected with an undesirable size, speed, trajectory, and/or are not ejected at all. Current droplet monitoring techniques use machine vision with strobed video or high speed camera. These techniques are expensive, time consuming, and can require extensive software development.

SUMMARY

According to one embodiment, an apparatus for the ink jet printer that includes an ejector, a spatial filter, a detector, and an analyzer. The ejector is configured to release an ink droplet along a path and the spatial filter has a plurality of features. The detector is positioned to sense light emanating from the droplet along the path with the sensed light being modulated according to the features as the droplet moves along the path relative to the spatial filter. The detector is configured to generate a time-varying electrical signal in response to the sensed light. The analyzer determines one or more physical, spatial, or dynamic characteristics of the droplet based upon the time-varying signal.

In another embodiment, a system includes an ink jet print head, an optical component, one or more detectors, and an analyzer. The inkjet print head has a plurality of ejectors. Each ejector is configured to release one or more droplets along one or more paths. The optical component is configured to provide a measurement light. The one or more detectors are positioned to detect light emanating from each of the one or more droplets along the one or more paths in response to the measurement light. The detected light is modulated as the one or more droplets move along a detection region and the detector is configured to generate one or more time-varying signals in response to the detected light. The analyzer is configured to simultaneously distinguish and determine one or more dynamic, physical, and spatial characteristics of the one or more droplets and correlate each of the one or more droplets with one of the plurality of ejectors based upon the one or more time-varying signals.

Some embodiments involve a method of analyzing delivery of inkjet droplets from a print head that includes releasing a droplet from an ejector of the print head, sensing a modulated light from the droplet moving along a path relative to a spatial filter, generating a time-varying signal in response to the detected light, and analyzing the time-varying signal to determine one or more dynamic, physical, and spatial characteristics of the droplet based upon the time-varying signal.

Additional embodiments involve a method that includes sensing a modulated light from a ink droplet moving along a path relative to a spatial filter, generating a time-varying signal in response to the detected light, and analyzing the time-varying signal to determine one or more dynamic characteristics of the droplet including a separation of the droplet from a plurality of droplets, a combination of the droplet with one or more additional droplets, and a uniformity or non-uniformity of speed, size, trajectory, and shape of a group of sequentially released droplets including the droplet.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
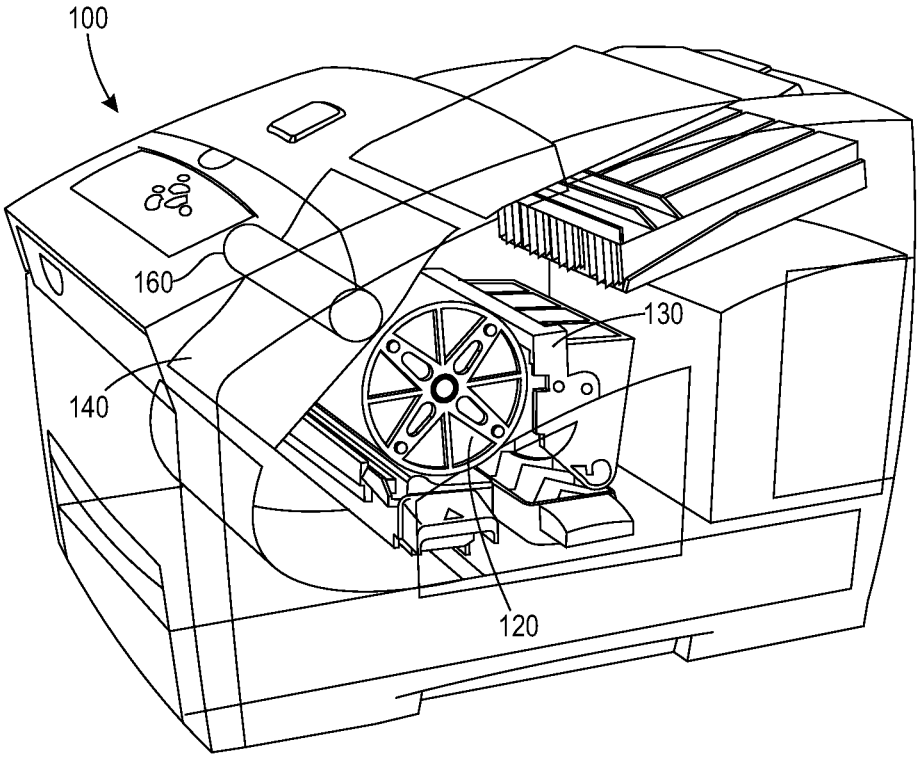
FIGS. 1A and 1B provide internal views of portions of an ink jet printer that incorporates a droplet monitoring apparatus.

Non-uniformities in the passages and nozzles of inkjet print heads can cause misplaced, intermittent, missing or weak ink jetting resulting in undesirable visual flaws in the final printed pattern. The disclosed techniques are applicable to desk jet as well as industrial print applications. In yet other implementations, the ink can be deposited onto previously deposited material for fabrication of a three dimensional object.

Although approaches are discussed with reference to ink droplets for inkjet printing, these approaches are also relevant to any application where the physical, spatial, dynamic and/or other characteristics of droplets are measured. This disclosure describes a monitoring and analysis device and related techniques, methods, systems, and apparatuses that can be used to monitor and analyze the characteristics of ink droplets ejected from an inkjet print head using light emanating from the ink droplets. More particularly, the application describes analysis techniques and an analyzer that can be used to measure physical, spatial and dynamic characteristics of the ink droplets such as droplet speed, shape, size, location, trajectory, uniformity of behavior between a group of droplets, splitting/combining of droplets, and composition based upon patterned light emanating from the ink droplets. Light emanating from the droplets can originate from a multitude of physical processes including: Fluorescence, scattering, up-conversion, second harmonic generation, multi-photon excited fluorescence, Raman scattering, phosphorescence, absorption etc.

The approaches described can aid in the monitoring and analysis of ink droplet delivery, as well as provide a cost effective and less complex alternative to strobed video or high speed camera methods.

In some embodiments, a control circuitry and/or software can be used in a feedback loop to vary one or more of the characteristics of the droplet based upon the determined one or more characteristics of a prior droplet(s).

It will be understood that the techniques, apparatuses, systems, and methods described herein are applicable to detect various droplet characteristics present in a sample. As used herein the term "droplet" refers broadly to droplets used in industrial applications and is not limited to desktop inkjet droplets. The term droplet can refer to one or more test droplets, droplets used during in-line printing application, a group of droplets from one or more ejectors, and a plurality of droplets from multiple ejectors monitored as part of a large scale array, etc. Thus, as used herein droplet includes one or more test droplets launched, monitored, and analyzed prior to or intermittent with normal printing operations (e.g., during warm-up, at desired intervals, prior to a large print job, etc.) The test droplets have characteristics that simulate the characteristics of droplets delivered to the print medium during normal in-line printing operation.

In some embodiments, one or more sensors can obtain information about the droplet by receiving a signal(s) therefrom; for example, the signal in the form of light can emanate from the droplet, whether through emission (e.g. radiation, fluorescence, incandescence, chemoluminescence, bioluminescence, other forms of luminescence, etc.), scattering (e.g. reflection, deflection, diffraction, refraction, etc.), or transmission, and can be sensed by a sensor such as a photodetector. Droplets may be treated, e.g., stained or tagged with a suitable fluorescent probe or other agent, in such a way that they emit light or absorb light in a predictable fashion when illuminated with excitation light. In this regard, the light emitted by a given excited droplet may be fluorescent in nature, or it may constitute a form of scattered light such as in the case of Raman scattering. For simplicity, the light that emanates (by e.g., scattering, emission, or transmission) from a droplet is referred to herein as "emanating light" "light emanating" or simply as "light" in some circumstances. Similarly, the light that emanates from a light source can be referred to as "excitation light", "incoming light", or "measurement light" herein. It will be understood that the techniques, assemblies, apparatuses, systems, and methods described herein are applicable to detecting all forms of light emanating from a droplet.

The embodiments described herein utilize various techniques and spatial filters disclosed in one or more of the Applicants' co-filed applications, application Ser. No. 14/181,560, entitled "Spatial Modulation of Light to Determine Object Position", application Ser. No. 14/181,524, entitled "Spatial Modulation of Light to Determine Dimensional Characteristics of Objects in an Injection direction", application Ser. No. 14/181,571, entitled "Determination of Color Characteristics of Objects Using Spatially Modulated Light", and application Ser. No. 14/181,530, entitled "Spatial Modulation of Light to Determine Object Length", co-pending herewith. These co-pending applications are herein incorporated by reference in their entirety.

In some embodiments, the concentration and/or presence of an analyte in a droplet can be measured using varies techniques, for example, as disclosed in co-owned U.S. patent application Ser. No. 13/826,198, entitled "Compositions and Methods for Performing Assays" (Recht et al.), filed Mar. 14, 2013, U.S. patent application Ser. No. 13/627,739, entitled "Multiplexed Flow Assay Based On Absorption-encoded Micro Beads", (Kiesel et al.), filed Sep. 26, 2012, and U.S. Pat. App. Publ. No. 2013/0037726 (Kiesel et al.), the disclosures of which are incorporated herein by reference in their entirety.

These and other disclosed techniques can be deployed in a variety of printer applications for analysis of system properties and/or detection of various characteristics of droplets. As previously discussed, using the techniques disclosed herein, it is possible to determine one or more physical, spatial and dynamic characteristics of the ink droplets such as droplet speed, shape, size, location, trajectory, uniformity of behavior between a group of droplets, splitting/combining of droplets, and composition based upon patterned light emanating from the ink droplets. In some instances, the droplet composition can be obtained using florescence and can be indicative of a degradation of the ink in some instances. The size/shape of each droplet can be measured in up to three dimensions, and a three dimensional position of the droplet during a path to a medium can be determined. Additionally, as the droplet travels in time and space, additional information can be obtained including trajectory information such as angles of travel in up to three dimensions and the droplet speed.

Embodiments described herein may involve the use of at least one spatial filter and/or optics that provide patterned excitation light and/or may involve the use of at least one spatial filter and/or optics that spatially modulate the light emanating from the droplets. As each droplet moves along an injection direction, the droplet emanates light that is spatially modulated or otherwise patterned and detected by a detector. The detector generates a time-varying signal in response to the sensed patterned light. In some implementations, a non-imaging or non-pixilated photodetector can be used to generate the time-varying signal based on the patterned light.

The time-varying signal includes information about the droplet's characteristics (e.g., spatial, physical, and/or dynamic). In some embodiments, the time-varying signal can be analyzed in the time domain to extract the desired information regarding the droplet. For example, the time-varying signal may be compared or correlated to a known template signal and/or the time-varying signal may be analyzed by examining various morphological and durational characteristics of the time-varying signal. In some embodiments, the time-varying signal may be transformed from the time domain to the frequency domain and the analysis may be carried out on the frequency domain signal.

Figure 1B:
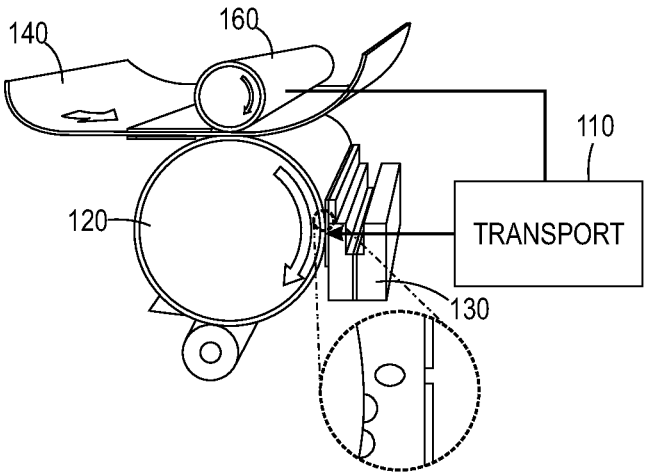

FIGS. 1A and 1B provide internal views of portions of an exemplary ink jet printer 100 that incorporates techniques for performing sample analysis by evaluating light emanating from ink droplets as discussed herein. The printer 100 includes a transport mechanism 110 that is configured to move the drum 120 relative to the print head 130 and to move the print medium 140 relative to the drum 120. The print head 130 may extend fully or partially along the length of the drum 120 and includes a number of ejectors, also called ink jets. As the drum 120 is rotated by the transport mechanism 110, the ejectors of the print head 130 deposit droplets of ink though nozzles onto the drum 120 in the desired pattern as illustrated the inset circle in FIG. 1B. As the print medium 140 (e.g., paper) travels over the drum 120, the pattern of ink on the drum 120 is transferred to the print medium 140 through a pressure nip 160.

Figure 2:
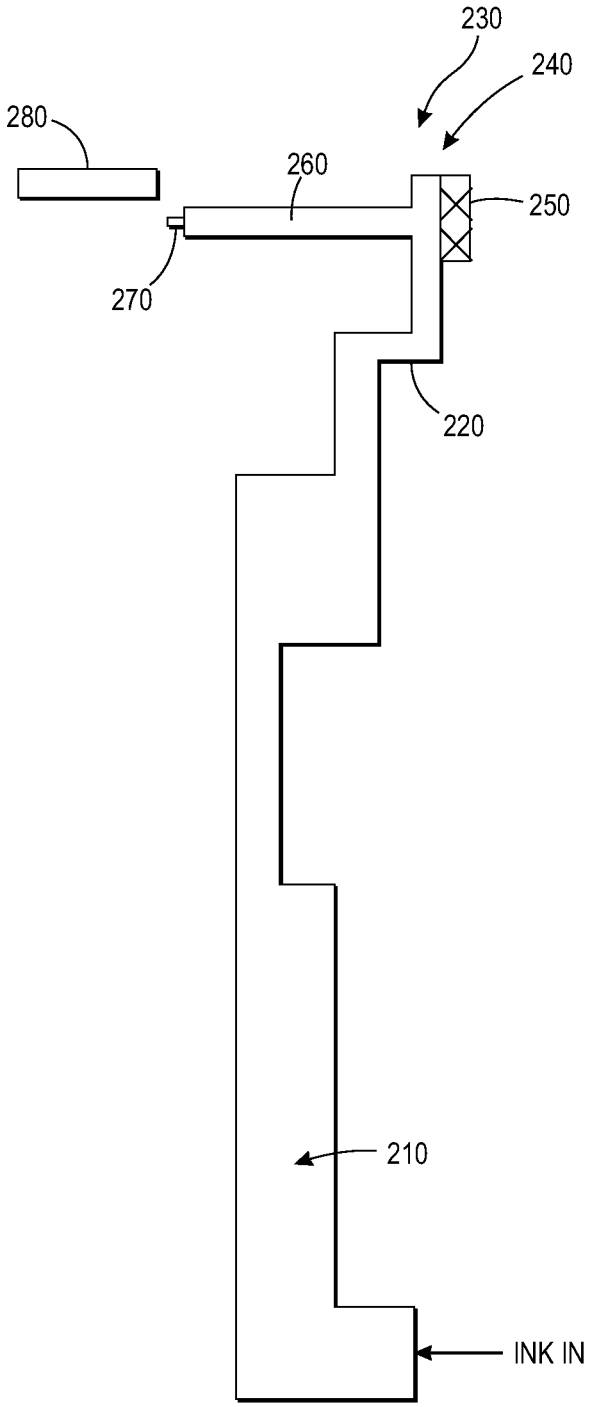
FIG. 2 is shows a possible location for a monitoring apparatus adjacent a nozzle of an ink jet print head.

FIG. 2 provides a highly schematic view of an exemplary print head 230. The path of molten ink, contained initially in a reservoir, flows through a port into a main manifold 210 of the print head 230. In some cases, there are four main manifolds 210, one main manifold 210 per ink color, and each of these main manifolds 210 connects to interwoven finger manifolds 220 through a series of passages. The ink passes through the finger manifolds 220 and then into the ejectors 240. The manifold and ink jet geometry illustrated in FIG. 2 is repeated to achieve a desired print head length, e.g. the full width of the drum. It will be appreciated that the specific configurations of the ink jet printer 100 and print head illustrated in FIGS. 1A, 1B, and 2 are provided as examples, and that ink jet printers and/or ink jet print heads have a variety of configurations applicable to the techniques discussed herein.

Each ejector 240 includes an actuator 250 that controls the ejection of the ink drops through a passage 260 and through an ink jet nozzle 270 onto the print medium, e.g., the drum. In some implementations, the actuator 250 comprises piezoelectric transducers (PZTs) for ink droplet ejection, although other methods of ink droplet ejection are known. Activation of the PZT causes a pumping action that alternatively draws ink into an inlet (not shown) from the finger manifolds 220 and expels the ink through the nozzle 270.

FIG. 2 indicates a possible location of a fixture 280 that can house components (e.g., a spatial filter and a detector) discussed subsequently. The fixture 280 is disposed generally adjacent the path droplets take between the ejector 240 and the print medium. Although the fixture 280 is illustrated as an object that can house components in the embodiment of FIG. 2, in other embodiments, the fixture 280 may not be used to house some of the systems and components used for detection and analysis or may not be used entirely.

Figure 3:
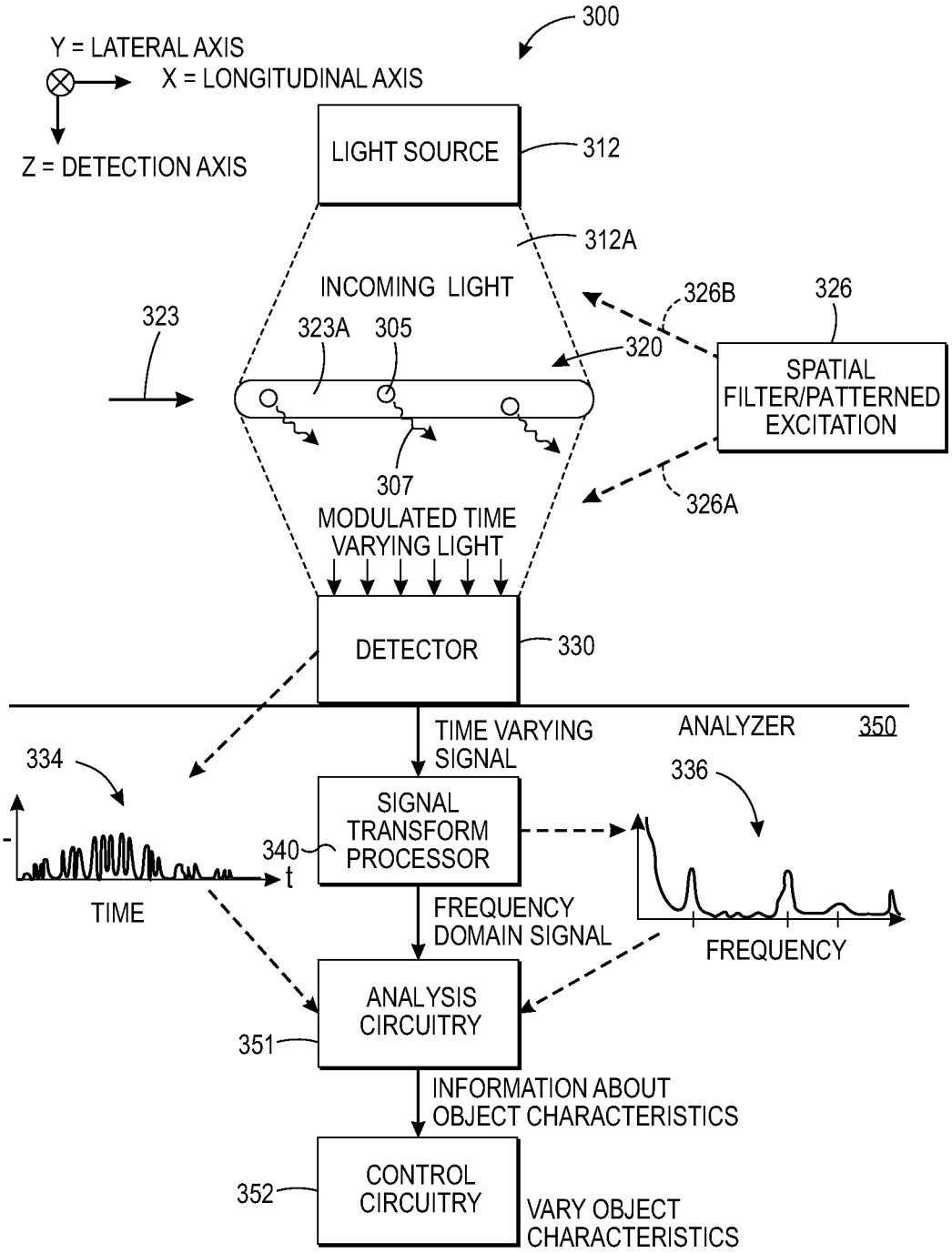
FIG. 3 is an example embodiment of an assembly with a detector and an analyzer configured to determine droplet characteristics based on spatially modulated light.

FIG. 3 is an example of an assembly 300 configured to determine droplet characteristics based on spatially modulated light. The assembly 300 includes a light source 312, a mask, e.g., a spatial filter 326, a detection region 320, a detector 330, a signal processor 340, and an analyzer 350. Components of the assembly are arranged in a coordinate system that includes a longitudinal axis, designated as the x-axis herein, a lateral axis, designated as the y-axis, and a depth axis, designated as the z-axis. In the description below, the injection direction is selected to lie generally along the longitudinal axis of the coordinate system, and the longitudinal, lateral, and depth axes are orthogonal to one another. Those skilled in the art will appreciate that any coordinate system could alternatively be selected, the arrangement of the assembly with respect to the coordinate system is arbitrary and does not change the operation of the assembly, and that non-orthogonal axis systems could alternatively be used.

The detection region 320 receives a sample of interest to be analyzed moving along the path 323 illustrated. The sample may move along the detection region 320 generally along the x-direction illustrated. However, as discussed subsequently, the sample may additionally or alternatively move along the detection region in the y-direction and/or z-direction illustrated. Excitation light emitted by the light source 312 interacts with the sample in an excitation region 323*a*. In this regard, the light source 312 may emit incoming (excitation) light 312*a* towards the detection region 320 in some embodiments such as the embodiment illustrated in FIG. 3.

In some cases, the light source 312 may comprise a conventional laser, a laser diode (LD), light emitting diode (LED) source, or a resonant cavity LED (RC-LED) source, for example. If desired, the light source may incorporate one or more filters to narrow or otherwise tailor the spectrum of the resultant output light. Whichever type of light source is selected, the spectral makeup or composition of the incoming light emitted by the light source 312 is preferably tailored to excite, scatter, or otherwise cause emanation of light from at least some of the droplets that may be present in the sample, as discussed further below.

The sample is depicted as containing droplets 305 that emanate light 307 in all directions (only some directions are illustrated). The droplets 305 may have a variety of characteristics, some of which can be determined by the analyzer 350 based on the emanating light 307.

The detector 330 receives time-varying light and generates an electrical signal in response to the time-varying light. The time variation in the light detected by the detector 330 may be the result of interaction between the excitation light and an input spatial filter to create spatially patterned excitation light that illuminates the droplet 305. Alternatively, the time variation in the light detected by the detector 330 may be the result of interaction between light emanating from the droplets 305 and an output spatial filter. In yet other embodiments, the time variation in the light detected by the detector 330 may be the result of excitation light or emanating light that is patterned using optical components such as micro-optics.

In some embodiments, the detector 330 includes an optical filter arranged between the detector and the objects. An optical filter can be particularly useful when the emanating light is fluorescent light and the optical filter is configured to substantially block the wavelengths of the excitation light and to substantially pass the wavelengths of the light emanating from the objects.

The assembly 300 of FIG. 3 includes the spatial filter 326 (sometimes referred to as a mask) and/or other optical components (for example lenses, waveguides, fiber optics, and/or micro-optics) which can be positioned in various locations. Dashed arrows 326*a* and 326*b* indicate possible locations of the spatial filter 326 and/or other optical components to provide spatially modulated excitation light and/or time modulated emanating light.

In some configurations, indicated by arrow 326*a*, the spatial filter can be disposed between the detection region 320 and the detector 330. In this position, the spatial filter is referred to as an output spatial filter. In other configurations, indicated by arrow 326*b*, the spatial filter can be disposed between the light source 312 and the detection region 320. In this position, the spatial filter is referred to as an input spatial filter. An input spatial filter may be adapted to transmit light emitted by the light source by varying amounts along the excitation region 323*a*. In this configuration, the input spatial filter creates patterned excitation light in the excitation region 323*a*. According to various implementations, an input spatial filter may comprise a physical spatial filter including a sequence or pattern of first regions that have a first optical characteristic, e.g., are more light transmissive, and second regions that have a second optical characteristic, different from the first characteristic, e.g., are less light transmissive. In some implementations, the first regions may be substantially clear and the second regions may be substantially opaque at the wavelengths of interest. Alternatively or in addition to a spatial filter, one or more optical components such as micro-optics or a patterned light source configured to create the excitation pattern can be utilized. The excitation pattern can be imaged and/or directed onto the excitation region 323*a* using additional optical components for the imaging (e.g., lenses) and/or direction, (e.g., fiber optics or waveguides).

In some embodiments, an output spatial filter may be utilized and disposed between the detection region 320 and the detector 330. In some embodiments, the excitation region 323*a* and the detection region 320 overlap. In other embodiments, there may be partial overlap between the excitation region and detection region or the excitation and detection regions may be non-overlapping or multiple detection regions and/or excitation regions may be used with various overlapping and/or non-overlapping arrangements. In some embodiments, the output spatial filter may be a physical spatial filter comprising a sequence or pattern of first regions that are more light transmissive and second regions that are less light transmissive. In some embodiments, color spatial filters may be used such that a first region of the color spatial filter is more transmissive to a first wavelength band and less transmissive to a second wavelength band and a second region of the color spatial filter is less transmissive to the first wavelength band and is more transmissive to the second wavelength band. As the emanating light from the droplet travels along the detection region 320 relative to the output spatial filter 326, the more transmissive and less transmissive regions of the spatial filter 326 alternatively transmit and block the light emanating from the droplet, creating time modulated light that falls on the detector 330. In response, the detector 330 generates a time varying electrical output signal 334.

According to some embodiments of an assembly 300 that include an input spatial filter, as the droplet 305 travels in the injection direction 323*c* in the excitation region 323*a*, light emanating from the light source 312 is alternately substantially transmitted to the droplet 305 and substantially blocked or partially blocked from reaching the droplet 305 as the droplet 305 travels along the path 323. The alternate transmission and non-transmission (or reduced transmission) of the excitation light 312*a* along the path 323 within the detection region 320 produces time-varying emanating light 307 emanating from the droplet 305. The time-varying emanating light 307 emanating from the droplet 305 falls on the detector 330 and, in response, the detector 330 generates a time-varying electrical output signal 334.

In some embodiments, as illustrated in FIG. 3, the analyzer 350 may include a signal transform processor 340 that converts the time-varying detector output signal 334 to a frequency domain output signal 336 so as to provide spectral response as a function of frequency. The signal transform processor 340 is shown as part of the analyzer 350 in this embodiment, but may be part of the detector in some embodiments or may comprise separate circuitry in other embodiments. For example, in some embodiments, the signal transform processor may be part of the analyzer circuitry along with the detector.

For conversion, the signal processor 340 may use known techniques such as discrete Fourier transform including, for example, a Fast Fourier Transform "FFT" algorithm. Thus, the frequency domain output signal 336 represents the frequency component magnitude of the time-varying detector output signal 334, where the frequency component magnitude is the amount of a given frequency component that is present in the time-varying detector output signal 334 or function. The Fourier signal power is a relevant parameter or measure because it corresponds to the function or value one would obtain by calculating in a straightforward manner the Fourier transform (e.g. using a Fast Fourier Transform "FFT" algorithm) of the time-varying signal 334. However, other methods or techniques of representing the frequency component magnitude, or other measures of the frequency component magnitude, may also be used. Examples may include e.g. the square root of the Fourier signal power, or the signal strength (e.g. as measured in voltage or current) obtained from a filter that receives as input the time-varying detector output signal 334.

In FIG. 3, the time-varying detector output signal 334 and/or the frequency domain detector output signal 336 can be passed to the analysis circuitry 351 of the analyzer 350. The analysis circuitry 351 is configured to receive the time-varying detector output signal 334 and/or the frequency domain output signal 336 and to determine one or more characteristics of the droplet 305 based upon the time-varying detector output signal 334 and/or the frequency domain output signal 336.

In some embodiments, a control circuitry 352 can be configured to vary one or more of the characteristics of the droplet 305 based upon the determined characteristics that result from the analyzer 350. Thus, the control circuitry 352 is configured to vary the one or more physical, spatial, or dynamic characteristics based upon the determined characteristics in some instances. For example, the control circuitry 352 can adjust a waveform of the piezoelectric transducer that drives the ejector (FIG. 2) to eject smaller or larger droplets, to eject droplets having faster or slower velocities, etc.

Figure 4:
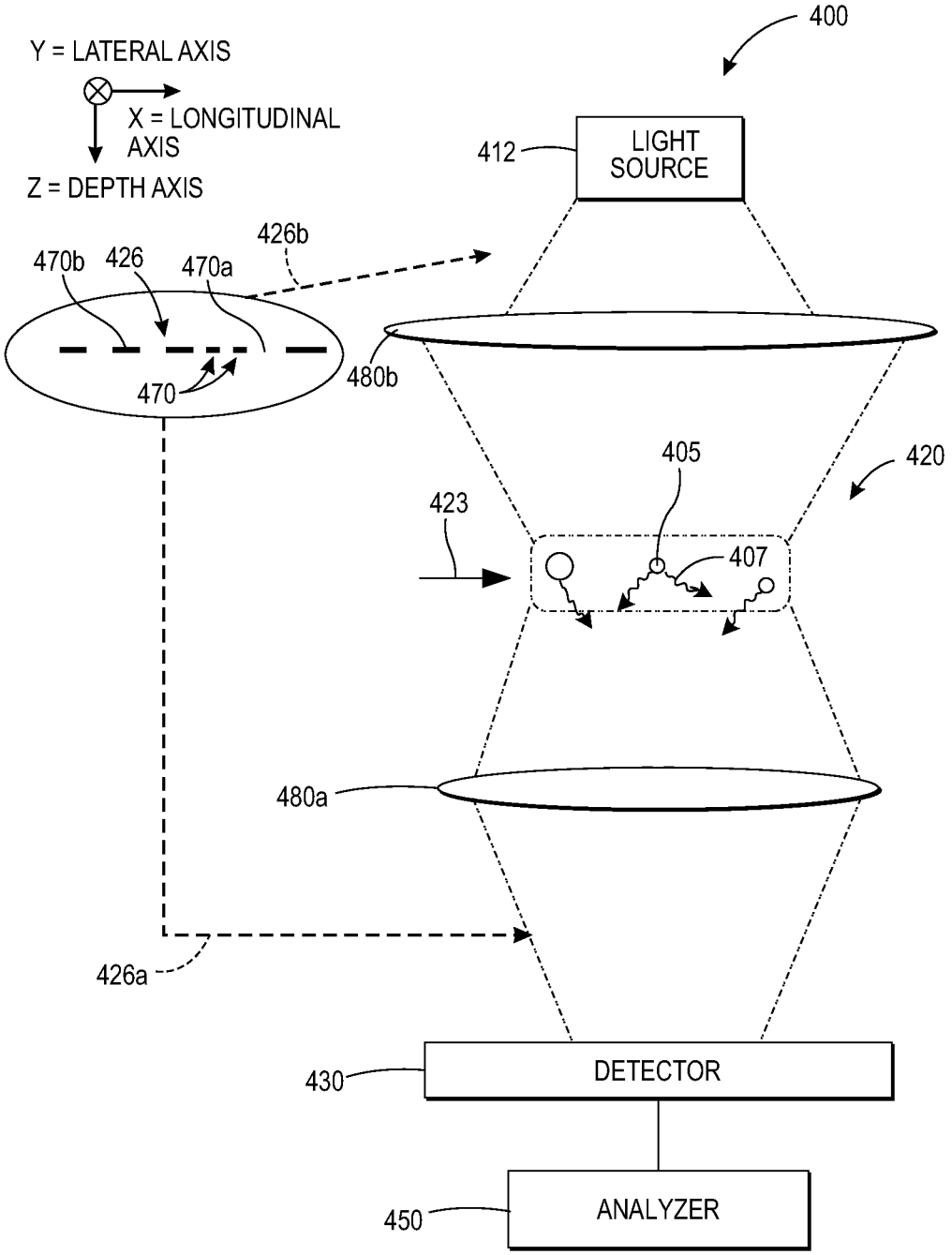
FIG. 4 is a schematic view of another example embodiment of an assembly with a detector, a light source, and an analyzer for determining droplet characteristics based upon patterned light.

FIG. 4 is an enlarged schematic view of a portion of an assembly 400 according to an example embodiment. The assembly 400 includes detection region 420, a detector 430, analyzer 450, and a spatial filter 426. A plurality of droplets 405 having differing sizes are illustrated passing through the detection region 420 along a path 423. In the embodiment shown in FIG. 4, a light source 412 is disposed to provide measurement light to the detection region 420. The measurement light can fall on optics 480*b* such as a waveguide, lens, etc. in some embodiments. Similarly, optics 480*a* can be used between the detection region 420 and the detector 430 in some embodiments. As illustrated by arrows 426*a* and 426*b*, the spatial filter 426 can be disposed on either of the measurement light side of detection region 420 or the emanating light side of the detection region 420 (adjacent detector 430 in some instances).

As illustrated in FIG. 4, the one or more droplets 405 that comprise the sample can have differing sizes and differing locations within the detection region 420 as measured by the Cartesian coordinate system illustrated. Each droplet 405 may have a different position along the detection region 420 in the x-direction (generally along the path 423) as well as different lateral position in the y axis direction of the Cartesian coordinate system and a different depth position in the z axis direction.

As discussed previously, the spatial filter 426 may comprise, for example, a mask. As will be discussed in greater detail subsequently, the spatial filter 426 may have a plurality of spatial filter features 470. The spatial filter features 470 include first features 470*a* having a first optical characteristic, e.g., more light transmissive regions, and second features 470*b* having a second optical characteristic, e.g., less light transmissive regions. For simplicity of explanation, many examples provided herein refer to spatial filter features comprising more light transmissive regions and spatial filter features or regions comprising less light transmissive regions. However, it will be appreciated that the optical characteristics of the first and second types of spatial filter features may differ optically in any way, e.g., the first features may comprise regions having a first optical wavelength pass band and the second features may comprise regions having a second optical wavelength pass band different from the first optical wavelength pass band. The pattern or sequence of first features 470*a* and second features 470*b* define a transmission function that affects light interacting with the spatial filter. When used as an output spatial filter, the interaction causes a time modulated signal that is dependent on the transmission function defined by the spatial filter and on a three dimensional position of a light 407 emanating from the droplet 405 (i.e., as measured along the x-direction, y-direction, and z-direction of the Cartesian coordinate system). This transmission function may be substantially periodic, or it may instead be substantially non-periodic. The time varying light transmitted by the spatial filter is sensed by the detector 430, which is configured to output the time-varying electrical output signal discussed in FIG. 3 in response.

In the embodiment of FIG. 4, the spatial filter 426 may be substantially monochromatic or polychromatic as desired. In a monochromatic spatial filter, the first features 470*a* may be more light transmissive and may all have substantially the same transmission characteristic, and the second features 470*b* may be less transmissive than the first features or may be non-transmissive (opaque) and also all have substantially the same transmission characteristic (different from that of the first features 470*a*). In a simple case, the transmissive first features 470*a* may all be completely clear, as in the case of an aperture, and the less transmissive second features 470*b* may be completely opaque, as in the case of a layer of black ink or other absorptive, reflective, or scattering material. Alternatively, the transmissive first features 470*a* may all have a given color or filter characteristic, e.g., high transmission for light emanating from an excited object, but low transmission for excitation light. Alternatively, the less transmissive second features 470*b* may have a low but non-zero light transmission, as in the case of a grey ink or coating, or a partial absorber or reflector.

Figure 5:
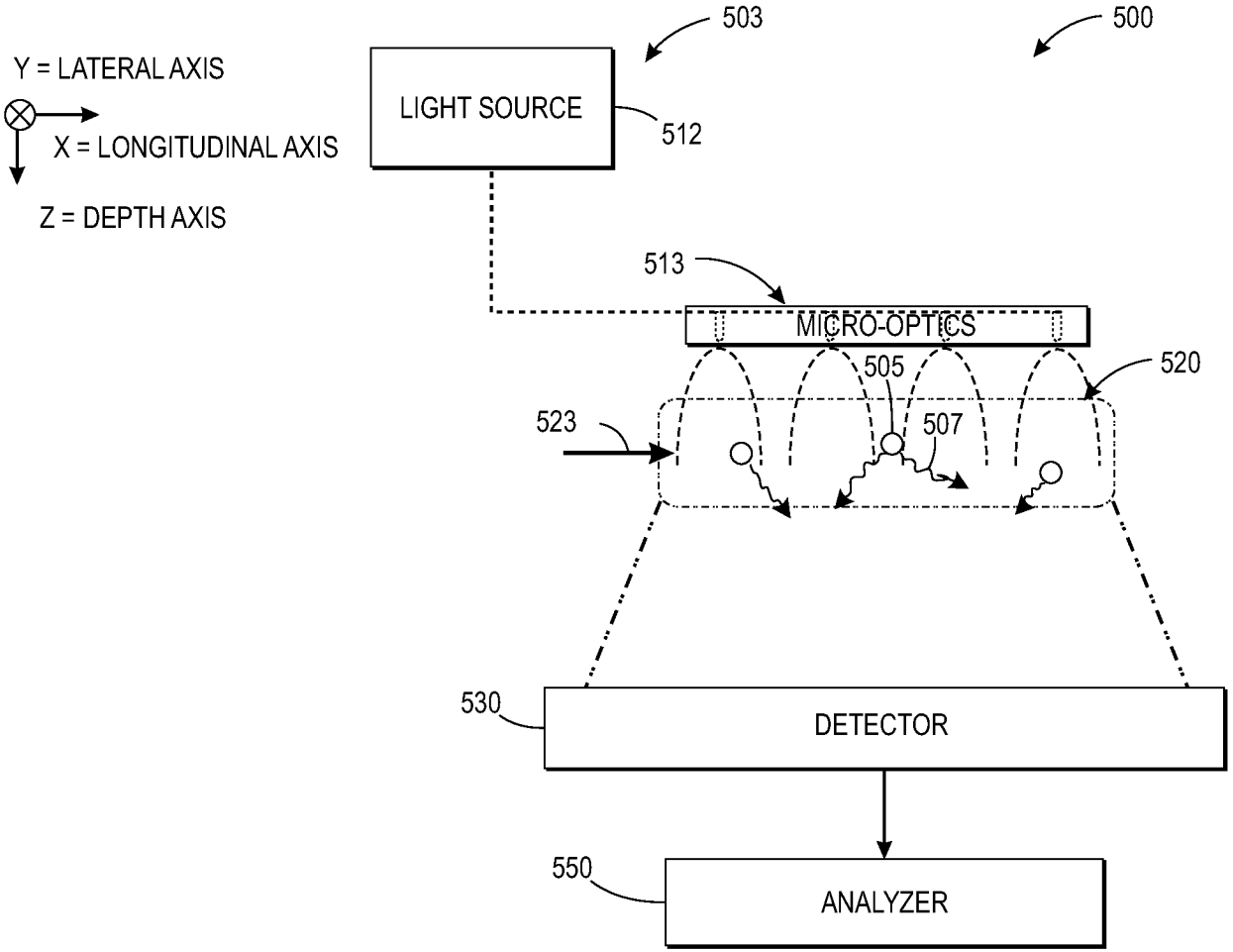
FIG. 5 is a schematic view of another example embodiment of an assembly using one or more optical components such as for example micro-optics.

FIG. 5 is a schematic view of another embodiment of a portion of an assembly 500. The portion of the assembly 500 illustrated includes optical components 503, a detection region 520, a detector 530, and an analyzer 550. Optical components 503 can include a light source 512 and light directing components 513.

A plurality of droplets 505 are illustrated entering the detection region 520 traveling along a path 523. In the embodiment of FIG. 5, the light source 512 is configured to provide a measurement light that is used to illuminate the droplet 505. In some cases, the light source 512 can comprise optical components such as micro-optics or a patterned light source configured to create a patterned measurement light. In other embodiments, the measurement light can be patterned by the spatial arrangement of the light directing components 513. The light directing components 513 are in optical communication with the light source 512 and receive the measurement light. The measurement light can be imaged and/or directed onto the detection region 520 by the light directing components 513. The light directing components 513 can include components for imaging light (e.g., lenses) and/or components for directing light, (e.g., fiber optics or waveguides) to produce spatially modulated excitation light.

In FIG. 5, the light directing components 513 are spaced in a known spaced relationship from one another. Thus, the measurement light emitted into the detection region 520 is in a known spatial relationship. In response to the measurement light, the light emanating 507 from the droplets 505 experiences a modulation in intensity and other characteristics due to variation in the intensity and other characteristics of the measurement light. The modulation in intensity and other characteristics of the light emanating 507 from the droplet 505 is captured by the detector 530. The characteristics of light emanating 507 changes based on a three dimensional position of the light 507 emanating from the droplet 505 within the detection region 520 (i.e., as measured along the x-direction, y-direction, and z-direction of the Cartesian coordinate system). This relationship may be substantially periodic, or it may instead be substantially non-periodic. The time-varying light emanating from the object is sensed by the detector 530, which is configured to generate the time-varying output signal in response to the sensed time-varying light, as discussed in FIG. 3.

Figure 6:
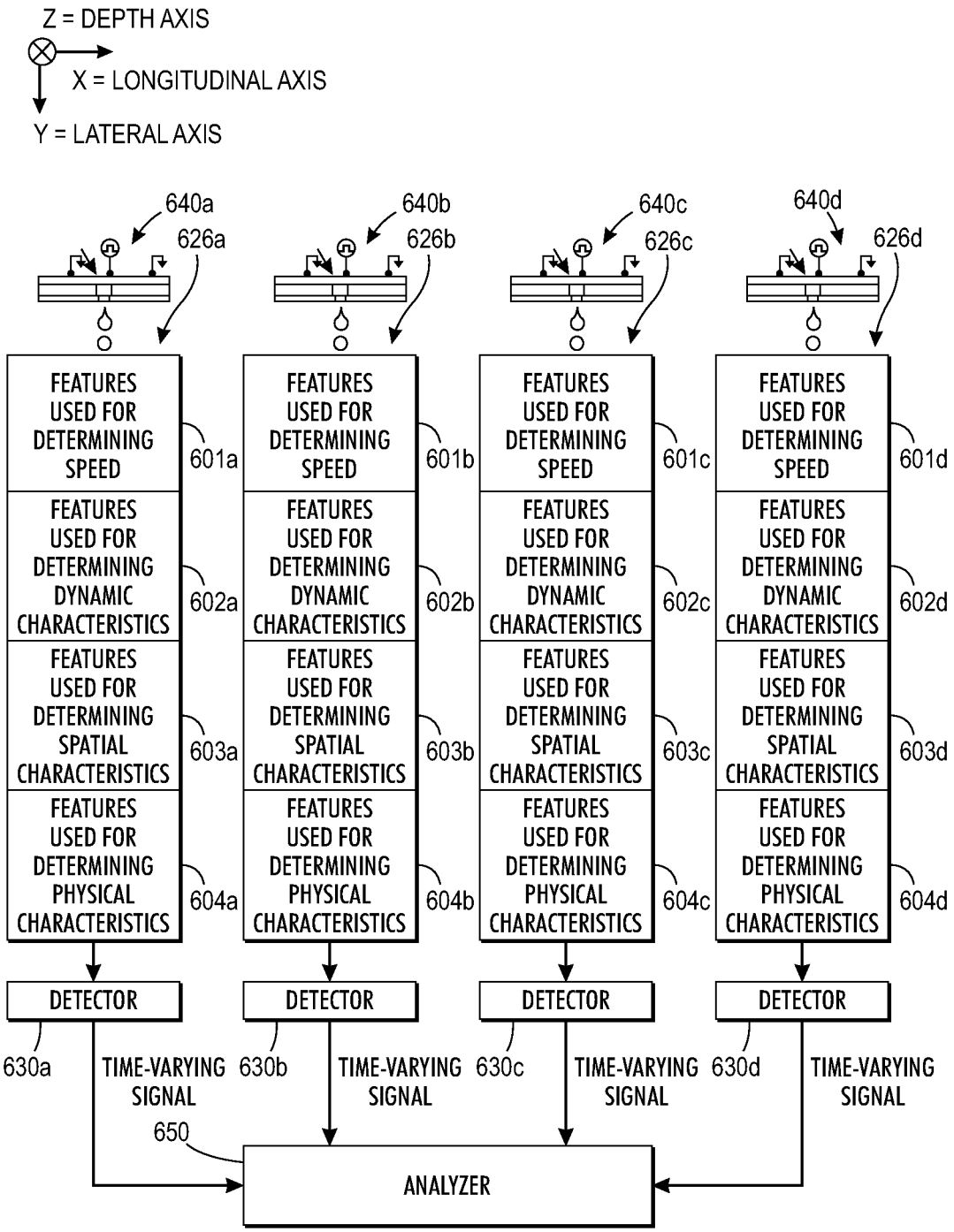
FIG. 6 is a schematic of one embodiment of an assembly of ejectors, spatial filters, detectors, and an analyzer for determining droplet characteristics based on spatially modulated light.

FIG. 6 illustrates a highly schematic arrangement of spatial filters 626*a*, 626*b*, 626*c*, and 626*d* and ejectors 640*a*, 640*b*, 640*c*, and 640*d*. Each spatial filter 626*a*, 626*b*, 626*c*, and 626*d* corresponds to one of the ejectors 640*a*, 640*b*, 640*c*, and 640*d*, and can include multiple types of spatial filter features that may be used to determine the characteristics of a droplet during a path to a print medium. Although illustrated as grouped separately along the longitudinal axis in FIG. 6, it should be recognized regions 601*a*, 602*a*, 603*a*, and 604*a* can be interdisposed with one another and/or can be grouped adjacent one another along the lateral and/or depth axes. FIG. 6 illustrates the spatial filters 626*a*, 626*b*, 626*c*, and 626*d* each having first, second, third, and fourth regions 601*a*, 601*b*, 601*c*, 601*d*, 602*a*, 602*b*, 602*c*, 602*d*, 603*a*, 603*b*, 603*c*, 603*d*, and 604*a*, 604*b*, 604*c*, and 604*d*, respectively. The first group of regions 601*a*, 601*b*, 601*c*, and 601*d* have features used for determining a speed of the droplets, the second group of regions 602*a*, 602*b*, 602*c*, and 602*d* have features used for determining dynamic characteristics of the droplets, the third group of regions 603*a*, 603*b*, 603*c*, and 603*d* have features used for determining spatial characteristics of the droplets, and the fourth group of regions 604*a*, 604*b*, 604*c*, and 604*d* have features used for determining physical characteristics of the droplets.

According to some embodiments, the physical characteristics of the objects can comprise one or more of a three dimensional shape, a three dimensional size, a length of the object in the longitudinal direction relative to the spatial filter, a width of the droplet in a lateral direction relative to the spatial filter, a thickness of the droplet in a depth direction relative to the spatial filter, and a composition. The spatial characteristics can comprise one or more of a location and trajectory of the droplet in two or three dimensions. The dynamic characteristics can comprise one or more of a speed of the droplet, a separation of the droplet into a plurality of droplets, a combination of the droplet with one or more additional droplets, and a uniformity or non-uniformity of speed, size, trajectory, and shape of a group of incrementally released droplets including the droplet.

In the embodiment of FIG. 6, the light modulated by the spatial filters 626*a*, 626*b*, 626*c*, and 626*d* is detected by a corresponding detector 630*a*, 630*b*, 630*c*, and 630*d*. In other embodiments, the detectors can comprise a single large area detector (discussed subsequently). The detectors 630*a*, 630*b*, 630*c*, and 630*d* each generate a time-varying signal that includes information about characteristics of the objects. The information can be extracted when the time varying output signal is analyzed by an analyzer 650.

As discussed, in some instances each spatial filter 626*a*, 626*b*, 626*c*, and 626*d* can include less or more than four regions. Additionally, different groups of features may be disposed within the same region (interdisposed). The longitudinal arrangement of the different groups of features may be changed from embodiment to embodiment. For example, the first group 601*a*, 601*b*, 601*c*, and 601*d* of features used to determine the speed may be disposed in other regions. Not all regions may be used in some embodiments.

Figure 7A:
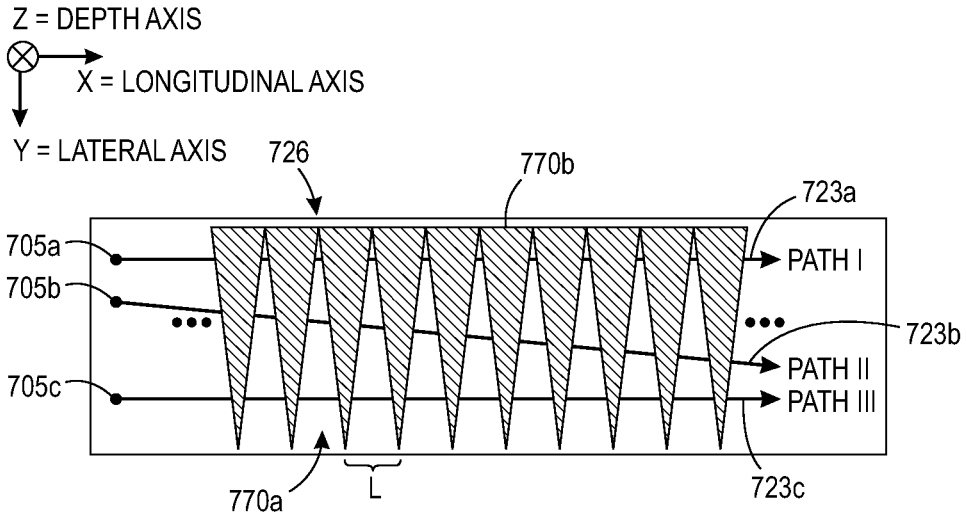
FIG. 7A is a plan view of droplets moving relative to a spatial filter along various paths.

FIG. 7A illustrates an arrangement of a spatial filter 726. A first droplet 705*a*, a second droplet 705*b*, and a third droplet 705*c* are illustrated passing relative the spatial filter 726 along various paths 723*a*, 723*b*, and 723*c*. As shown in FIG. 7A, the droplets 705*a*, 705*b*, and 705*c* may be disposed in different lateral positions (as measured in the y-axis of the Cartesian coordinate system) with respect to the spatial filter 726 and travel along paths 723*a*, 723*b*, and 723*c* with different trajectories. The spatial filter 726 is adapted with more transmissive features 770*a* having a changing longitudinal length L along the lateral axis in order to aid in the determination of the position and the trajectory. Additionally, the paths 723*a*, 723*b*, and 723*c* can differ in trajectory with respect to the spatial filter 726 as measured by the depth axis and longitudinal axis. The spatial filter 726 is configured to determine the trajectory of the droplets 705*a*, 705*b*, and 705*c* along 723*a*, 723*b*, and 723*c*. The droplets 705*a*, 705*b*, and 705*c* can have a speed with respect to the spatial filter 726 that can be determined, for example, by analyzing the frequency of the time varying output signal where objects having a higher speed produce light that varies at a higher frequency.

Figure 7B:
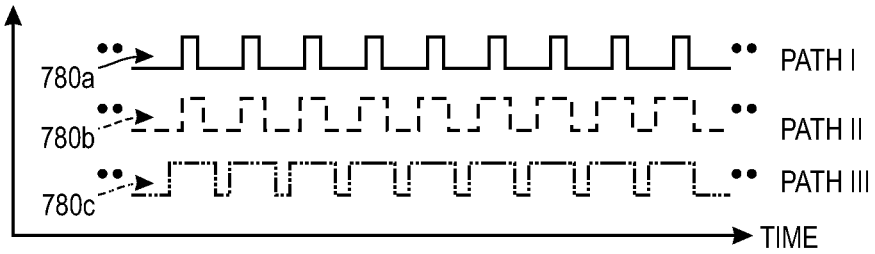
FIG. 7B is a plot that shows time-varying signals that result from the three delivery paths illustrated in FIG. 7A.

FIG. 7B illustrates three time-varying signals 780*a*, 780*b*, and 780*c* generated by the movement of the droplets 705*a*, 705*b*, and 705*c* past the spatial filter 726. In particular, the movement of the droplets 705*a*, 705*b*, 705*c* past more transmissive features 770*a* (FIG. 7A) leads to higher amplitude regions in the first time-varying signal 780*a*, the second time-varying signal 780*b*, and the third time-varying signal 780*c* relative to regions having a lower amplitude. These lower amplitude regions result from the droplets 705*a*, 705*b*, and 705*c* passing adjacent less transmissive features 770*b* (FIG. 7A) that block or at least partially block light emissions from the droplets 705*a*, 705*b*, and 705*c*.

As illustrated in FIG. 7B, light emanating from the droplet 705*a* is detected and the first time-varying signal 780*a* is generated. Similarly, light emanating from the second droplet 705*b* is detected and the second time-varying signal 780*b* is generated. Likewise, light emanating from the third droplet 705*c* is detected and the third time-varying signal 780*c* is generated. The time-varying signals 780*a*, 780*b*, and 780*c* may have one or more characteristics (amplitude, frequency, pitch, duty cycle, etc.) that aid in determination of one or more characteristics of the droplets 705*a*, 705*b*, and 705*c* along the paths 723*a*, 723*b*, and 723*c*. For example, reviewing the first time-varying signal 780*a* one may ascertain the speed of the droplet 705*a* and determine that the speed of the droplet 705*a* differs from the speed of the second droplet 705*b*.

Spatial filter 726 can also be used to determine one or more dynamic characteristics of droplets 705*a*, 705*b*, and 705*c*. In particular, if droplets 705*a*, 705*b*, and 705*c* are released from an ejector as a sequential group the spatial filter 726 can be useful to determine dynamic characteristics such as a uniformity or non-uniformity of speed, size, trajectory, and shape of the group as these characteristics can impact printing accuracy and clarity. As shown in FIG. 7B, the time-varying signals 780*a*, 780*b*, and 780*c* can be compared to one another (and to template signals, etc.) to determine the uniformity or non-uniformity of the aforementioned characteristics. Differences in the duty cycle of the time-varying signals 780*a*, 780*b*, and 780*c* allow for determination of the trajectory as the shape of the mask features in the spatial filter 726 are known.

Figure 8A:
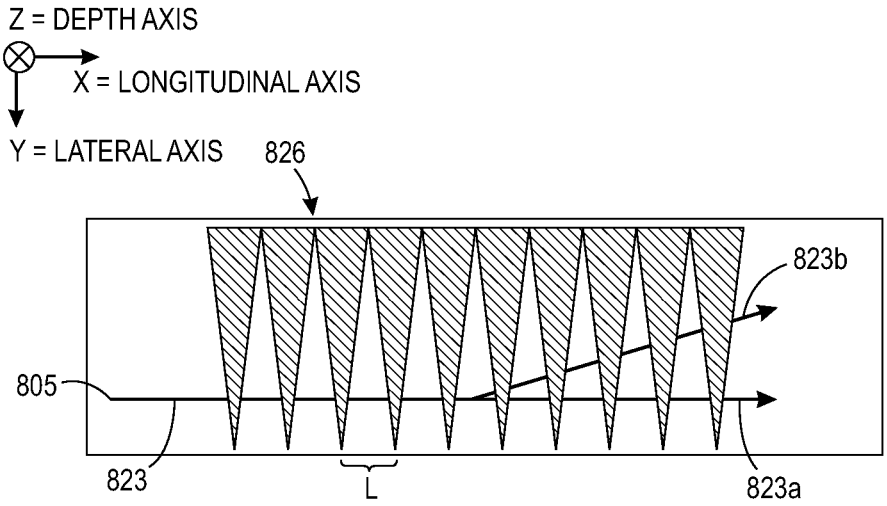
FIG. 8A is a plan view of a droplet moving relative to a spatial filter and exhibiting dynamic characteristics (splitting of the droplet to form two separate droplets)

FIG. 8A illustrates a spatial filter 826 having an identical shape and arrangement as the spatial filter 726 of FIG. 7A. FIG. 8A illustrates a droplet undergoing a dynamic characteristic, (i.e. a phenomenon where the droplet 805 splits into two or more separate droplets) along path 823. In the illustrated embodiment, the droplet 805 splits into two droplets. Thus, path 823 becomes paths 823*a* and 823*b*. As with the spatial filter 726 discussed previously, the spatial filter 826 additionally aids with determining a speed, trajectory, and position of droplet 805 including after the droplet 805 splits into two or more separate droplets.

Figure 8B:
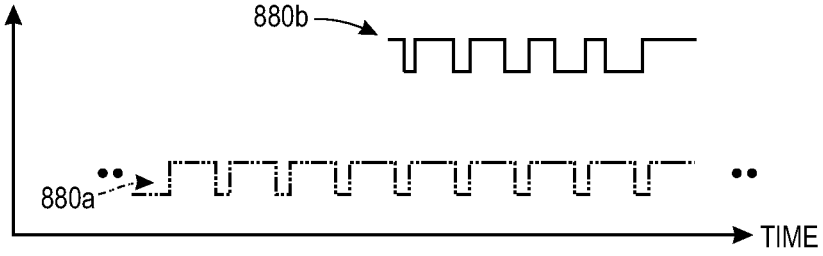
FIG. 8B is a plot of the time-varying signals that results from the dynamic characteristics of FIG. 8A.

FIG. 8B illustrates a first time-varying signals 880*a* generated by the movement of the droplet 805 and one of the separated droplets past the spatial filter 826 along paths 823 and 823*a*. Additionally, a second time-varying signal 880*b* with a delayed start is generated by the movement of a second of the separated droplets past the spatial filter 826 along path 823*b*. Both the first time-varying signal 880*a* and the second time-varying signal 880*b* are superimposed in the detector signal (since the signals 880*a* and 880*b* are measured simultaneously by the same detector) and data evaluation is used to separate both signals. The time-varying signals 880*a* and 880*b* may have one or more characteristics (amplitude, frequency, pitch, duty cycle, etc.) that aid in determination of one or more additional dynamic, physical, and spatial characteristics of the droplets.

It should be appreciated that a droplet undergoing a combination dynamic characteristic, (i.e. a phenomenon where a first droplet combines with a second droplet and perhaps additional droplets) can be identified in a manner somewhat similar to that described in FIGS. 8A and 8B. If such a combination occurs, the two or more time-varying signals generated by the movement of the droplets would be reduced and one or more additional physical and spatial characteristics (e.g., size, shape) could change.

Figure 9:
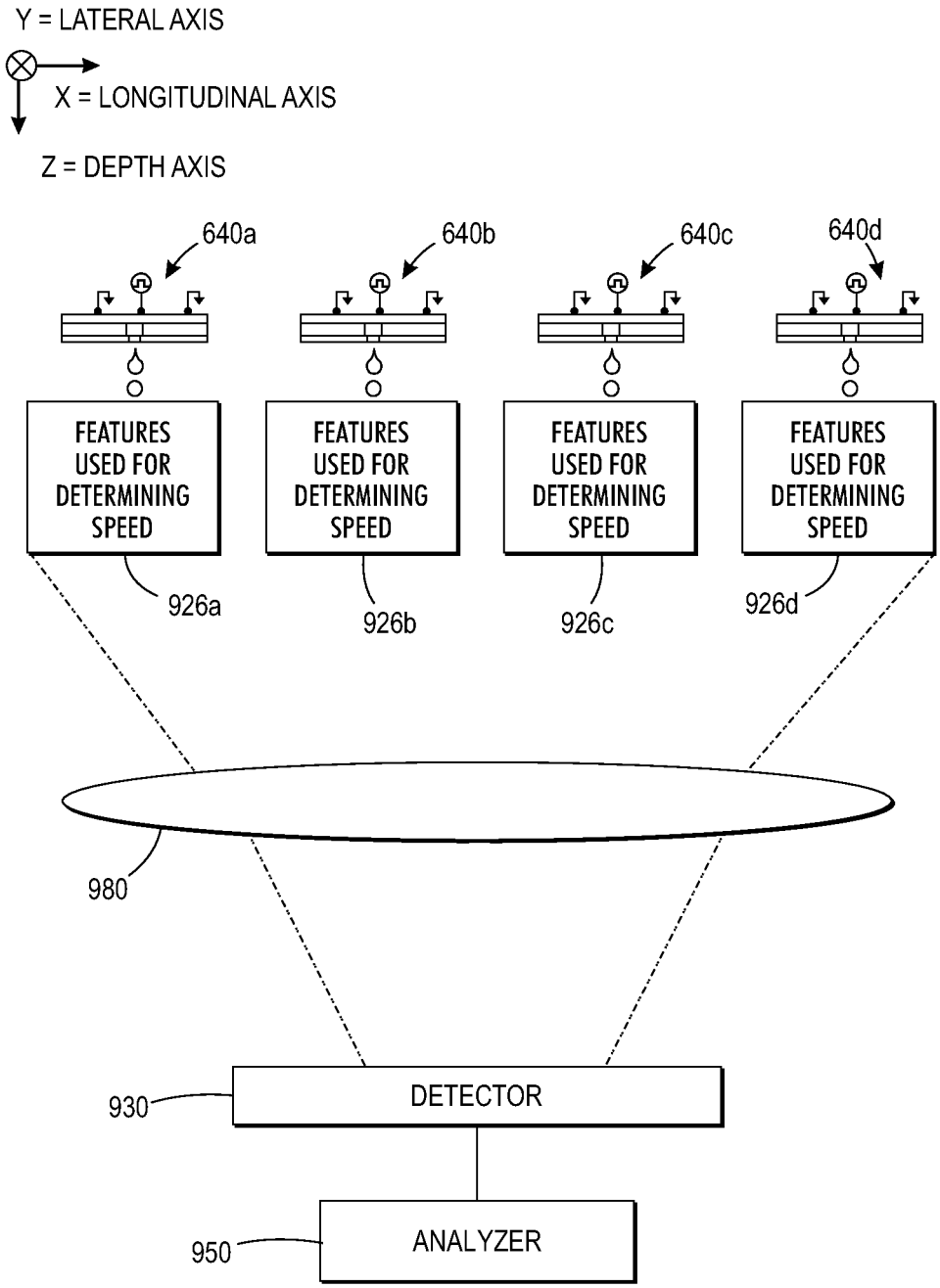
FIG. 9 is a schematic view of an arrangement of ejectors, spatial filters, optics, a detector, and an analyzer for determining droplet characteristics based on spatially modulated light according to yet another embodiment.

FIG. 9 illustrates a highly schematic arrangement of spatial filters 926*a*, 926*b*, 926*c*, and 926*d* and ejectors 940*a*, 940*b*,

940*c*, and 940*d* according to an exemplary embodiment. Each spatial filter 926*a*, 926*b*, 926*c*, and 926*d* corresponds to one of the ejectors 940*a*, 940*b*, 940*c*, and 940*d*, and includes mask features (not shown) that can be used to determine the speed of droplets during a path to a print medium.

The arrangement makes use of an optical component 980 such as a lens to focus light on a detector 930. In some embodiments, the detector 930 comprises a wide-area detector. The large area detector can determine which of the plurality of ejectors 940*a*, 940*b*, 940*c*, and 940*d* a droplet was released from and in some instances can simultaneously distinguish between trajectories of multiple droplets. For example, during printer warm-up each ejector 940*a*, 940*b*, 940*c*, and 940*d* may release a particle at a different time, such as sequentially, allowing for analysis of the droplets released with the large area detector. Additionally or alternatively, the features of each spatial filter 926*a*, 926*b*, 926*c*, and 926*d* can be sufficiently different such that analysis of the resulting time-varying signal for signature patterns would allow for determination of which of the ejectors 940*a*, 940*b*, 940*c*, and 940*d* the droplet was released from. In some instances, if two or more droplets are released from ejectors 940*a*, 940*b*, 940*c*, and 940*d* simultaneously complex data analysis can be used to separate the signals components and identify which of the ejectors 940*a*, 940*b*, 940*c*, and 940*d* the droplets were released from. Although it can be difficult to extract detailed information on the signal shape with two or more droplets released simultaneously, with a simple spatial filter 926*a*, 926*b*, 926*c*, and 926*d* arrangement such as shown in FIG. 9 one could extract droplet speeds. Additional data evaluation can be obtained if the spatial filter mask pattern is carefully chosen to allow for one or more characteristics (amplitude, frequency, pitch, duty cycle, etc.) in the time-varying signal that can be correlated to particular ejectors 940*a*, 940*b*, 940*c*, and 940*d*. For example, with a simple FFT of the time-varying signal one could extract characteristics (dynamic, physical, and spatial) of multiple droplets if the time-varying signal of each droplet is occurring at a different frequency and/or is producing a different amount of higher frequency components from other time-varying signals of the other droplets.

Detector 930 can be used to capture modulated light from multiple droplets passing through the multiple spatial filters 926*a*, 926*b*, 926*c*, and 926*d*. The detector 930 can output a time-varying signal to the analyzer 950 to determine characteristics of the droplets including but not limited to the speed. Thus, the spatial filters 926*a*, 926*b*, 926*c*, and 926*d*, analyzer 950, and detector 930 allow for distinction between multiple simultaneously imaged droplets. The analyzer 950 can be configured to perform parallel analysis on the time-varying signal in order to provide diagnostics on an inkjet print head to identify which of the ejectors 940*a*, 940*b*, 940*c*, and 940*d* may be in need of repair or adjustment.

Figure 10:
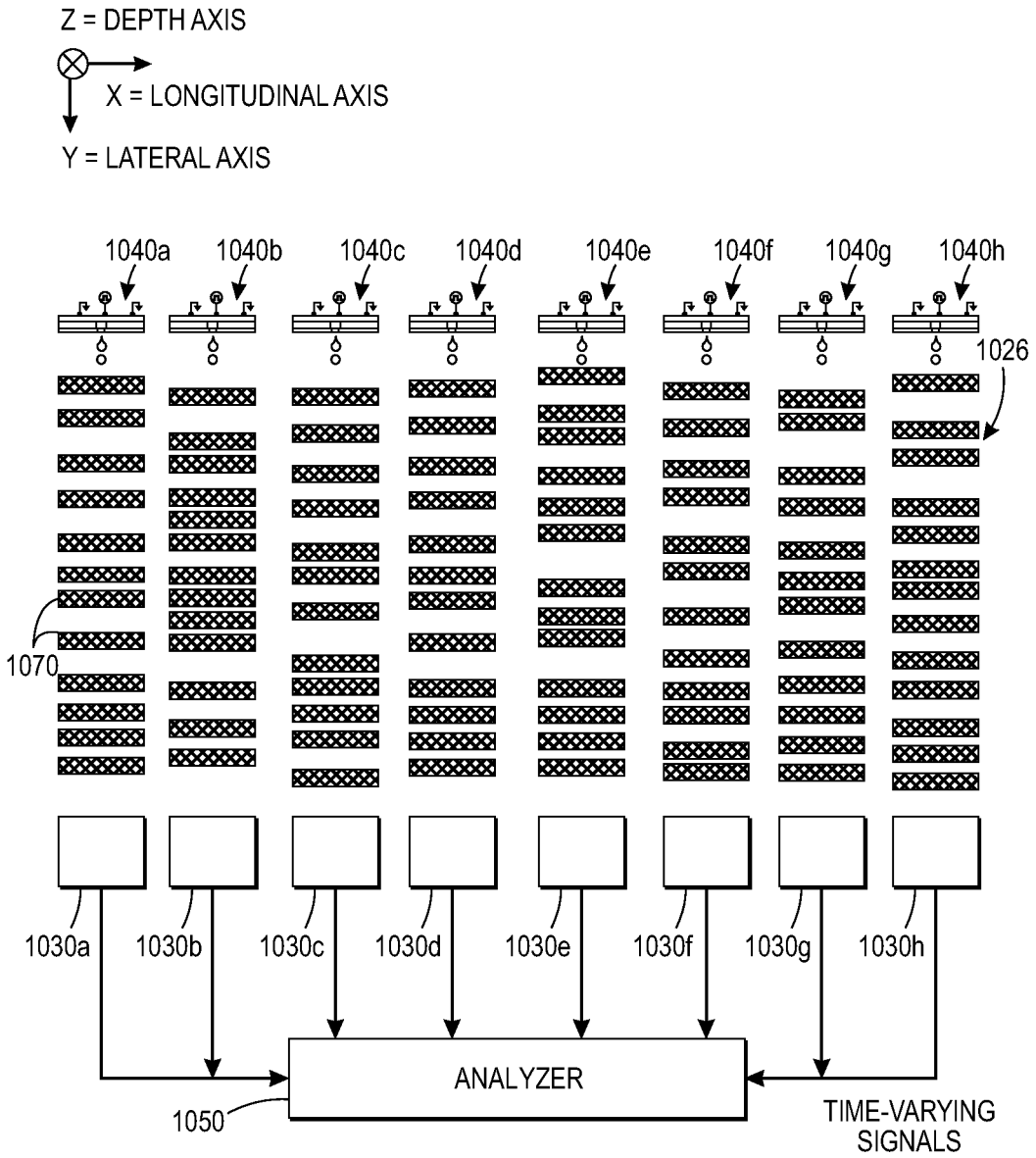
FIG. 10 is a schematic view of one embodiment of an arrangement of ejectors, spatial filters, a detector, and an analyzer for determining droplet characteristics based on spatially modulated light.

FIG. 10 illustrates a highly schematic arrangement of a single spatial filter 1026 and ejectors 1040*a*, 1040*b*, 1040*c*, 1040*d*, 1040*e*, 1040*f*, 1040*g*, and 1040*h* according to an exemplary embodiment. The spatial filter 1026 includes rows of uniquely spaced (and in some embodiments uniquely sized and/or shaped) mask features 1070. Each row of features 1070 is arranged to generally correspond to and provide modulated light from droplets ejected from one of the ejectors 1040*a*, 1040*b*, 1040*c*, 1040*d*, 1040*e*, 1040*f*, 1040*g*, and 1040*h*.

A plurality of detectors 1030*a*, 1030*b*, 1030*c*, 1030*d*, 1030*e*, 1030*f*, 1030*g*, and 1030*h* are illustrated in the embodiment of FIG. 10. Each detector is positioned to capture modulated light from one of the uniquely positioned rows of features 1070. However, as discussed with reference to FIG. 9, in some instances a single detector such as a large-area detector can be used. The example embodiment described in FIG. 10 makes use of a single spatial filter 1026, however, in other embodiments a plurality of spatial filters each having a different pattern that can be used for each ejector for which monitoring is desired.

Each detector 1030*a*, 1030*b*, 1030*c*, 1030*d*, 1030*e*, 1030*f*, 1030*g*, and 1030*h* generates a time-varying signal that is passed to the analyzer 1050 which can determine which of the plurality of ejectors 1040*a*, 1040*b*, 1040*c*, 1040*d*, 1040*e*, 1040*f*, 1040*g*, and 1040*h* the droplet was released from and can simultaneously distinguish between trajectories, speed, etc. of multiple droplets.

As shown in FIG. 10, the spatial filter 1026 has a different arrangement of features 1070 corresponding to each of the plurality of ejectors 1040*a*, 1040*b*, 1040*c*, 1040*d*, 1040*e*, 1040*f*, 1040*g*, and 1040*h* to allow for a determination of which of the plurality of ejectors the droplet was released from. The spatial filter 1026, with differentiated rows of features 1070, analyzer 1050, and detector 1030 allow for distinction between multiple simultaneously droplets. The analyzer 1050 can be configured to perform parallel analysis on the time-varying signal in order to provide diagnostics on an inkjet print head to identify which of the ejectors 1040*a*, 1040*b*, 1040*c*, 1040*d*, 1040*e*, 1040*f*, 1040*g*, and 1040*h* may be in need of repair or adjustment.

Figure 11:
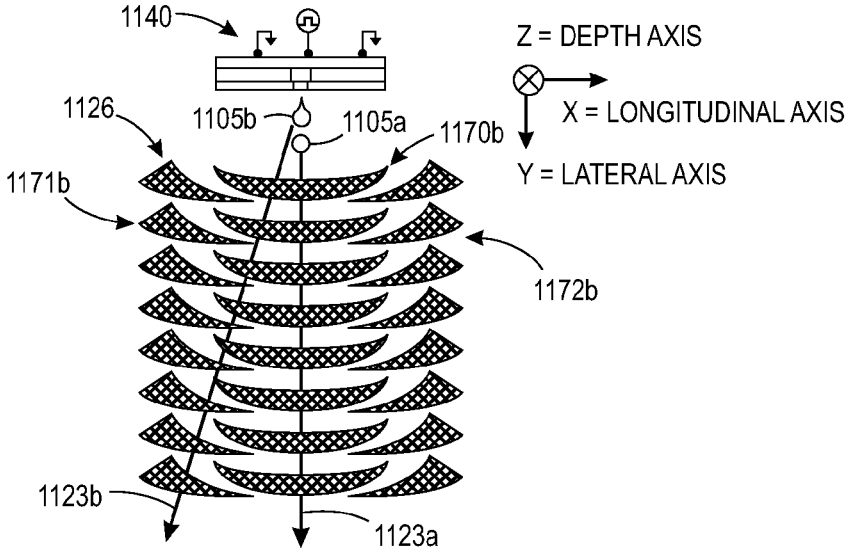
FIG. 11 is a schematic view of an ejector and an embodiment of a spatial filter for determining a trajectory of a droplet.

FIG. 11 shows a schematic plan view of a spatial filter 1126 and ejector 1140 with two droplets 1105*a* and 1105*b* being released from the ejector 1140 but each following different paths 1123*a* and 1123*b*. The spatial filter 1126 can be used with additional filter designs in a manner discussed previously in reference to FIG. 6 to determine one or more dynamic, spatial, and physical characteristics of the droplets.

The spatial filter 1126 includes several less transmissive feature patterns 1170*b*, 1171*b*, and 1172*b*. In particular, the first less transmissive feature pattern 1170*b* is centered between the second less transmissive feature pattern 1171*b* and the third less transmissive feature pattern 1172*b*. In the exemplary embodiment, the first less transmissive feature pattern 1170*b* includes less transmissive features that have a curved shape with a known size, shape (including angles) and relative spacing. This known geometry allows for even slight deviations in the path of a droplet to be detected using analysis of the time-varying signal. In some instances, the first less transmissive feature pattern 1170*b* is used as the primary feature pattern for identifying a desired path of droplets to the print medium. Thus, droplet 1105*a* and path 1123*a* are shown as illustrating the desired path of a droplet.

The second less transmissive feature pattern 1171*b* is disposed laterally adjacent the first less transmissive feature pattern 1170*b* and has a known size, shape (including angles) and relative spacing both in relation to its own features and in relation to the first less transmissive feature pattern 1170*b*. A portion of each less transmissive feature in the second less transmissive feature pattern 1171*b* additionally extends longitudinally adjacent the less transmissive features of the first less transmissive feature pattern 1170*b*. Thus, to some extent the second less transmissive feature pattern 1171*b* is interleaved with the first less transmissive feature pattern 1170*b*. The third less transmissive feature pattern 1172*b* is mirrored to the second less transmissive feature pattern 1171*b* in the exemplary embodiment. Thus, the third less transmissive feature pattern 1172*b* is to some extent interleaved with the first less transmissive feature pattern 1170*b* in the manner described previously. The extent of such interleaving is a matter of design preference. A greater degree of interleaving will better capture smaller angles of deviation from the desired path (e.g., path 1123*a*). One such deviation from the desired path is illustrated by path 1123*b*. Thus, in some instances the second less transmissive feature pattern 1171*b* and/or the third less transmissive feature pattern 1172*b* can be used as the primary feature pattern(s) for identifying a deviation from the desired path.

Figure 11A:
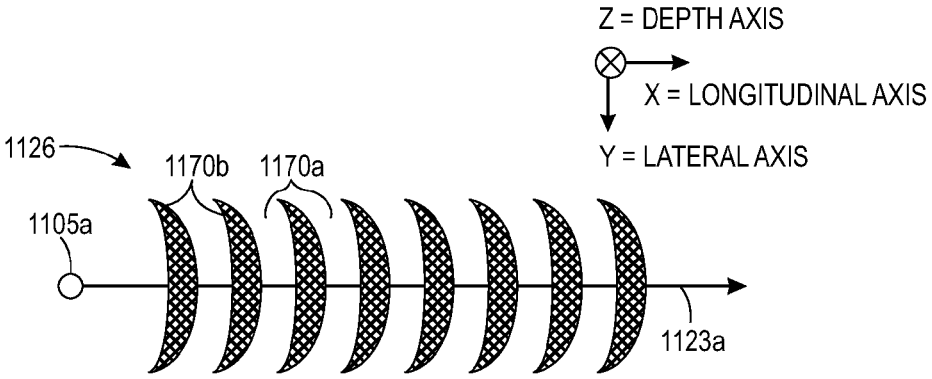
FIG. 11A is a plan view of a droplet moving relative to the spatial filter from FIG. 11 along a first path.

FIG. 11A is a plan view of a portion of the spatial filter 1126 comprising the first less transmissive feature pattern 1170*b*. The first less transmissive feature pattern 1170*b* is shown in isolation from the second less transmissive feature pattern 1171*b* and the third less transmissive feature pattern 1172*b*. FIG. 11A shows the first droplet 1105*a* passing in a substantially longitudinal direction (as measured by the x axis of the coordinate system illustrated) relative to the first less transmissive feature pattern 1170*b*.

Figure 11B:
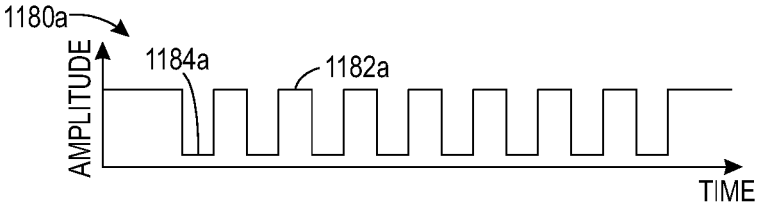
FIG. 11B is a time-varying signal that results from the spatial filter and the droplet moving along the first path of FIG. 11A.

FIG. 11B shows a first time-varying signal 1180*a* that results from detected light that has passed relative to the first less transmissive feature pattern 1170*b* as well as a first more transmissive pattern 1170*a* (shown in FIG. 11A). The pattern of the first less transmissive feature pattern 1170*b* and the first more transmissive pattern 1170*a* produces peak regions 1182*a* and trough regions 1184*a* in the time-varying signal 1180*a*. As the geometry of the first less transmissive feature pattern 1170*b* is known, (e.g., has less transmissive features that have a known size, shape, and relative spacing) the first time-varying signal 1180*a* can have one or more characteristics (amplitude, frequency, pitch, duty cycle, etc.) that can be correlated using the known geometry of the first less transmissive feature pattern 1170*b* to aid in determination of one or more additional dynamic, physical, and spatial characteristics of the droplets.

Figure 11C:
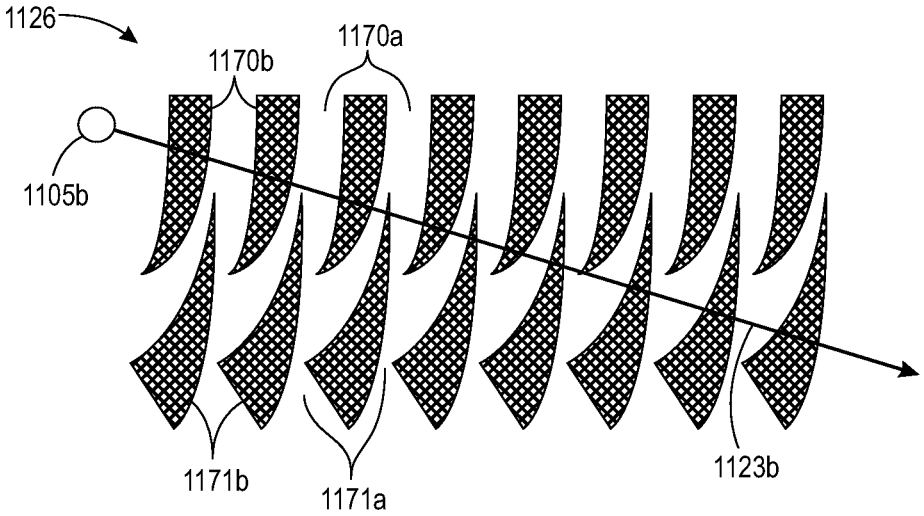
FIG. 11C is a plan view of a second droplet moving relative to a second portion of the spatial filter of FIG. 11 along a second path.

FIG. 11C shows a plan view of a portion of the spatial filter 1126 showing the path 1123*b* of the second droplet 1105*b* relative to the first less transmissive feature pattern 1170*b* and the second less transmissive feature pattern 1171*b*.

Figure 11D:
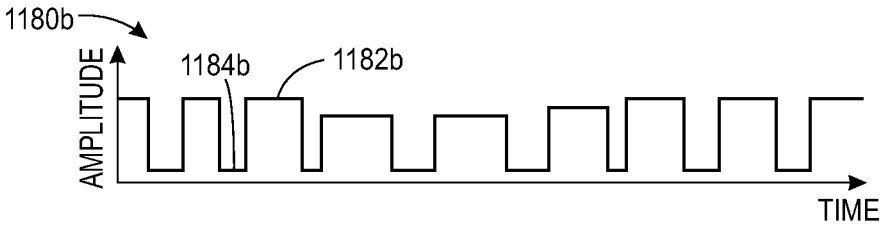
FIG. 11D is a time-varying signal that results from the spatial filter and second droplet moving along the second path of FIG. 11C.

FIG. 11D shows a second time-varying signal 1180*b* that results from detected light that has passed relative to the first less transmissive feature pattern 1170*b* and the second less transmissive feature pattern 1171*b*. In particular, the first more transmissive pattern 1170*a* (shown in FIGS. 11A and 11D) along with the second more transmissive feature pattern 1170*b* produces peak regions 1182*b* in the second time-varying signal 1180*b*. The first less transmissive feature pattern 1170*b* and the second less transmissive feature pattern 1171*b* produces trough regions 1184*b* in the second time-varying signal 1180*b*. The shape and duration of the peak regions 1182*b* and trough regions 1184*b* can be altered when passing from more closely adjacent the first less transmissive feature pattern 1170*b* to more closely adjacent the second less transmissive feature pattern 1171*b* as illustrated. As the geometry of the first less transmissive feature pattern 1170*b* and the second less transmissive feature pattern 1171*b* are known, (e.g., have less transmissive features that have a known size, shape, and relative spacing) the second time-varying signal 1180*b* can have one or more characteristics (amplitude, frequency, pitch, duty cycle, etc.) that can be correlated using the known geometry to aid in determination of one or more additional dynamic, physical, and spatial characteristics of the droplets.

In particular, the second time-varying signal 1180*b* can be used to determine trajectory information such as angles relative to the desired path. It should be noted from comparison of first time-varying signal 1180*a* of FIG. 11B with the second time-varying signal 1180*b* that the signals 1180*a* and 1180*b* have a same periodicity but a different duty cycle, an indication that a droplet is not following a desired path.

Figure 12:
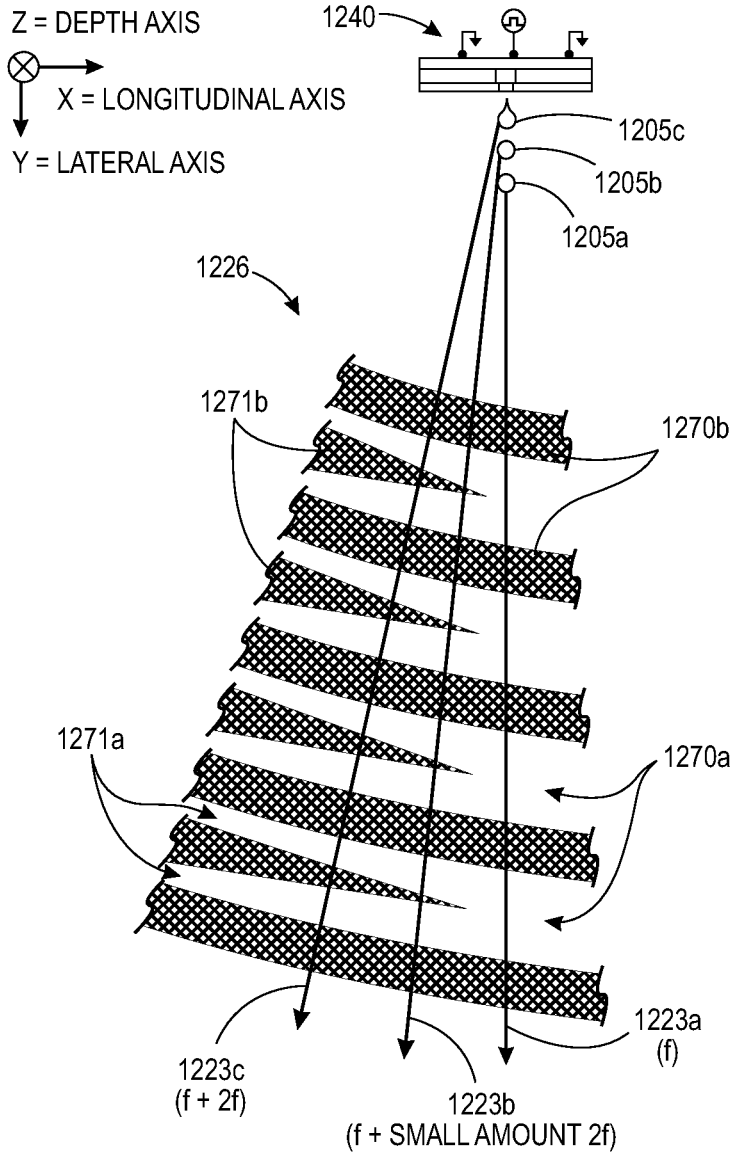
FIG. 12 is a flow diagram of a method for analyzing the delivery of inkjet droplets from a print head.

FIG. 12 shows a schematic plan view of a portion of a spatial filter 1226 and ejector 1240 with three droplets 1205*a*, 1205*b*, and 1205*c* being released from the ejector 1240 but each following different paths 1223*a*, 1223*b*, and 1223*c*. The spatial filter 1226 is similar in design to the spatial filter 1126 of FIGS. 11-11D but has modified mask features to allow for a simple FFT analysis (i.e., by building the ratio between f and 2f). Thus, the arrangement of FIG. 12 would allow for a determination of the angle the droplet had deviated from an ideal trajectory. The spatial filter 1226 can be used with additional filter designs in a manner discussed previously in reference to FIG. 6 to determine one or more dynamic, spatial, and physical characteristics of the droplets.

The spatial filter 1226 can include several less transmissive feature patterns, however, only less transmissive feature patterns 1270*b* and 1271*b* are illustrated. In the exemplary embodiment, the first less transmissive feature pattern 1270*b* includes less transmissive features that have a curved shape with a known size, shape (including angles) and relative spacing.

The second less transmissive feature pattern 1271*b* is disposed laterally adjacent the first less transmissive feature pattern 1270*b* and has a known size, shape (including angles) and relative spacing both in relation to its own features and in relation to the first less transmissive feature pattern 1270*b*. In the embodiment illustrated, a first more transmissive feature pattern 1270*a* has a dimension (e.g., area) that is roughly twice that of a second more transmissive feature pattern 1271*a*. Additionally shown in FIG. 12, the less transmissive feature pattern 1270*b* can have a dimension (e.g. thickness) that is roughly the same as a corresponding dimension of the second less transmissive feature pattern 1271*b* in some instances. The spatial filter 1226 can be configured as illustrated to be more informative if feature patterns (e.g., less transmissive feature patterns 1270*b* and 1271*b*) are provided with a configuration such that with increasing deviation of the droplet from an ideal trajectory (illustrated as path 1223*a*) the influence of the less transmissive feature patterns 1271*b* would become more and more dominate in the sensed time-varying signal. Assuming droplets 1205*a*, 1205*b*, and 1205*c* have the same velocity, the time modulated signal generated of droplet will be mainly dominated by frequency f (determined by the speed and periodic pattern 1270*b*), whereas the modulated signal for droplets 1205*b* and 1205*c* will be getting more influenced by pattern 1271*b* which creates 2f frequency. A simple FFT and building the ratio between f and 2f would allow for information to be gained on the angle the droplet had deviated from the ideal trajectory (e.g., 1205*a*).

Figure 13:
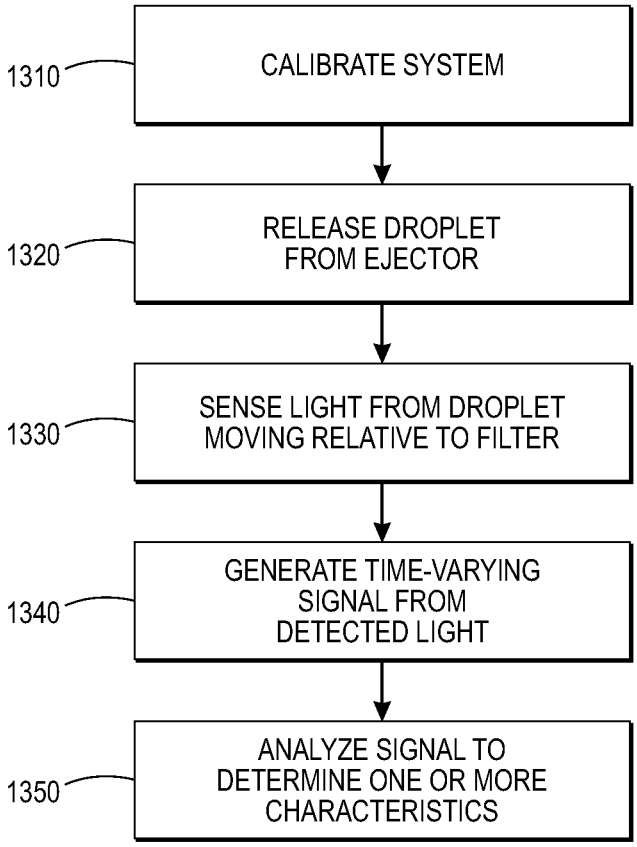
FIG. 13 shows a flow diagram of a method of monitoring delivery of one or more droplets from a print head according to one embodiment.

FIG. 13 shows a flow diagram of a method of monitoring delivery of one or more droplets from a print head according to one embodiment. As part of an optional initialization 1310 for the system, droplets of a known size, shape, and/or luminescence, etc. are passed along paths relative to a spatial filter at different depths and/or lateral positions so that the system can be calibrated. At step 1320, a droplet is released from an ejector of the print head. A modulated light from the droplet is sensed as the droplet moves along a path relative to a spatial filter in step 1330. A time-varying signal is generated in response to the detected light at step 1340. In step 1350, the time-varying signal is analyzed to determine one or more dynamic, physical, and spatial characteristics of the droplet based upon the time-varying signal.

In some instances, the method can additionally include a plurality of ejectors and the spatial filter has a plurality of features with a varied arrangement for each of the plurality of ejectors. Additionally, the method can perform parallel analysis on the time-varying signal in order to provide diagnostics on the print head in some embodiments. In additional embodiments, the method can additionally provide a fluorescence light to the droplet to excite the fluorescence within the droplet to generate light from the droplet. In further methods, a waveform of a piezoelectric transducer that drives the ejector can be adjusted.

In yet another embodiment, a method is disclosed that senses a modulated light from an ink droplet moving along a path relative to a spatial filter. The method generates a time-varying signal in response to the detected light. The time-varying signal is analyzed to determine one or more dynamic characteristics of the droplet including a separation of the droplet into a plurality of droplets, a combination of the droplet with one or more additional droplets, and a uniformity or non-uniformity of speed, size, trajectory, and shape of a group of sequentially released droplets including the droplet.

Although the subject matter has been described in language specific to structural features and/or methodological acts, it is to be understood that the subject matter defined in the appended claims is not necessarily limited to the specific features or acts described above. Rather, the specific features and acts described above are disclosed as representative forms of implementing the claims.

What is claimed is:

1. An apparatus for an ink jet printer, comprising:

an ejector configured to release an ink droplet along a path within the ink jet printer;

a spatial filter having a plurality of features;

a detector positioned to sense light emanating from the droplet along the path, the sensed light being modulated according to the plurality of features as the droplet moves along the path relative to the spatial filter, the detector configured to generate a time-varying electrical signal in response to the sensed light; and an analyzer to determine one or more characteristics of the droplet based upon the time-varying signal.

2. The apparatus of claim 1, wherein the characteristics include physical characteristics that comprise one or more of a three dimensional shape, a three dimensional size, a width of the droplet in a lateral direction relative to the spatial filter, a length of the droplet in a longitudinal direction relative to the spatial filter, and a thickness of the droplet in a depth direction relative to the spatial filter.

3. The apparatus of claim 1, wherein the characteristics include spatial characteristics that comprise one or more of a location and trajectory of the droplet in multiple dimensions.

4. The apparatus of claim 1, wherein the characteristics include dynamic characteristics that comprise one or more of a speed of the droplet, a separation of the droplet into a plurality of droplets, a combination of the droplet with one or more additional droplets, and a uniformity or non-uniformity of speed, size, trajectory, and shape of a group of sequentially released droplets including the droplet.

5. The apparatus of claim 1, further comprising control circuitry configured to vary the one or more physical, spatial, or dynamic characteristics based upon the determined characteristics.

6. The apparatus of claim 5, wherein the control circuitry adjusts a waveform of a piezoelectric transducer that drives the ejector.

7. The apparatus of claim 1, wherein the ejector comprises a plurality of ejectors and the detector comprises a large area detector, and wherein the large area detector can determine which of the plurality of ejectors the droplet was released from and determine the one or more characteristics of the droplet during a printer warm-up operation.

8. The apparatus of claim 1, wherein the wherein the ejector comprises a plurality of ejectors and the detector comprises a plurality of detectors, and wherein the plurality of detectors can determine which of the plurality of ejectors the droplet was released from and can simultaneously distinguish between the one or more characteristics of multiple droplets during normal printing operation.

9. The apparatus of claim 1, wherein the ejector comprises a plurality of ejectors and the spatial filter comprises one or more of spatial filters, and wherein the one or more spatial filters have a different arrangement of features corresponding to each of the plurality of ejectors to allow for a determination of which of the plurality of ejectors the droplet was released from.

10. The apparatus of claim 1, further comprising:

a medium disposed in the path adjacent the ejector;

a fixture disposed between the ejector and the medium, wherein the spatial filter and the detector are housed in the fixture.

11. The apparatus of claim 1, wherein the spatial filter, analyzer, and detector allow for distinction between multiple simultaneously detected droplets.

12. The apparatus of claim 1, wherein analyzer is configured to perform parallel analysis on the time-varying signal in order to provide diagnostics on an inkjet print head.

13. A system comprising:

an inkjet print head having a plurality of ejectors, each ejector configured to release one or more droplets along one or more paths;

an optical component configured to provide a measurement light;

one or more detectors positioned to detect light emanating from each of the one or more droplets along the one or more paths in response to the measurement light, the detected light being modulated as the one or more droplets move along a detection region, the one or more detectors configured to generate one or more time-varying signals in response to the detected light; and an analyzer configured to simultaneously distinguish and determine one or more characteristics of the one or more droplets and correlate each of the one or more droplets with one of the plurality of ejectors based upon the one or more time-varying signals.

14. The system of claim 13, further comprising a spatial filter having a plurality of features, and wherein the plurality of features have a varied arrangement for each of the plurality of ejectors.

15. The system of claim 14, wherein the characteristics include physical characteristics that comprise one or more of a three dimensional shape, a three dimensional size, a width of each of the one or more droplets in a lateral direction relative to the spatial filter, a length of the droplet in a longitudinal direction relative to the spatial filter, and a thickness of each of the one or more droplets in a depth direction relative to the spatial filter.

16. The system of claim 13, wherein the characteristics include spatial characteristics that comprise one or more of a location and trajectory of each of the one or more droplets in one, two, three, and four dimensions.

17. The system of claim 13, wherein the dynamic characteristics comprise one or more of a speed of each of the one or more droplets, a separation of each of the one or more droplets into additional droplets, a combination of the one or more droplets with additional droplets, and a uniformity or non-uniformity of speed, size, trajectory, and shape of a group of sequentially released droplets ejected from one of the plurality of ejectors.

18. The system of claim 13, wherein the analyzer is configured to perform parallel analysis on the one or more time-varying signals in order to provide diagnostics on the inkjet print head.

19. The system of claim 13, further comprising optics that provide a pattern to the measurement light along the detection region.

20. A method of analyzing delivery of inkjet droplets from a print head, comprising:

releasing a droplet from an ejector of the print head;

sensing a modulated light from the droplet moving along a path relative to a spatial filter;

generating a time-varying signal in response to the detected light; and analyzing the time-varying signal to determine one or more characteristics of the droplet based upon the time-varying signal.

21. The method of claim 20, wherein the ejector comprises a plurality of ejectors and the spatial filter has a plurality of features with a varied arrangement for each of the plurality of ejectors.

22. The method of claim 20, further comprising performing parallel analysis on the time-varying signal in order to provide diagnostics on the print head.

23. The method of claim 20, further comprising:

providing a fluorescence in the droplet; and exciting the fluorescence within the droplet to generate light from the droplet.

24. The method of claim 20, further comprising adjusting a waveform of a piezoelectric transducer that drives the ejector.

25. A method comprising:

sensing a modulated light from a ink droplet moving along a path relative to a spatial filter;

generating a time-varying signal in response to the detected light; and analyzing the time-varying signal to determine one or more dynamic characteristics of the droplet including a separation of the droplet into a plurality of droplets, a combination of the droplet with one or more additional droplets, and a uniformity or non-uniformity of speed, size, trajectory, and shape of a group of sequentially released droplets including the droplet.

* * * * *

UNITED STATES PATENT AND TRADEMARK OFFICE

CERTIFICATE OF CORRECTION

PATENT NO. : 9,114,606 B1
APPLICATION NO. : 14/246893
DATED : August 25, 2015
INVENTOR(S) : Ready et al.

It is certified that error appears in the above-identified patent and that said Letters Patent is hereby corrected as shown below:

IN THE SPECIFICATION:
At column 1, line 5, please delete the following section header and paragraph:

"STATEMENT REGARDING FEDERALLY SPONSORED RESEARCH AND DEVELOPMENT
This invention was made with government support under contract number NIH 1R21EB011662-01, awarded by the National Instutite of Health (NIH). The U.S. Government has certain rights in this invention."

Signed and Sealed this
Twenty-eighth Day of June, 2016

Michelle K. Lee

Michelle K. Lee
*Director of the United States Patent and Trademark Office*